US006683241B2

(12) United States Patent
Wieder

(10) Patent No.: US 6,683,241 B2
(45) Date of Patent: Jan. 27, 2004

(54) PSEUDO-LIVE MUSIC AUDIO AND SOUND

(76) Inventor: James W. Wieder, 4276 Hermitage Dr., Ellicott City, MD (US) 21042

( * ) Notice: Subject to any disclaimer, the term of this patent is extended or adjusted under 35 U.S.C. 154(b) by 0 days.

(21) Appl. No.: 10/012,732

(22) Filed: Nov. 6, 2001

(65) Prior Publication Data

US 2003/0084779 A1 May 8, 2003

(51) Int. Cl.[7] ..... A63H 5/00; G04B 13/00; G10H 7/00

(52) U.S. Cl. ..... 84/609; 84/615; 84/649; 84/653

(58) Field of Search ..... 84/600–607, 609–611, 84/615, 618, 622–626, 634–635, 649–651, 653, 656, 659–660, 662, 666–667

(56) References Cited

U.S. PATENT DOCUMENTS 4,787,073 A 11/1988 Masaki
5,281,754 A 1/1994 Farrett
5,315,057 A 5/1994 Land
5,350,880 A 9/1994 Sato
5,496,962 A 3/1996 Meier
5,663,517 A * 9/1997 Oppenheim ..... 84/649
5,728,962 A * 3/1998 Goede ..... 84/609
5,952,598 A 9/1999 Goede
6,051,770 A * 4/2000 Milburn et al. ..... 84/611
6,121,533 A 9/2000 Kay
6,153,821 A * 11/2000 Fay et al. ..... 84/634
6,169,242 B1 * 1/2001 Fay et al. ..... 84/609
6,215,059 B1 * 4/2001 Rauchi et al. ..... 84/611
6,230,140 B1 5/2001 Severson
6,281,421 B1 * 8/2001 Kawaguchi ..... 84/603
6,320,111 B1 11/2001 Kizaki
6,362,409 B1 * 3/2002 Gadre ..... 84/603
6,410,837 B2 * 6/2002 Tsutsumi ..... 84/604
6,433,266 B1 * 8/2002 Fay et al. ..... 84/609
6,448,485 B1 * 9/2002 Barile ..... 84/609

* cited by examiner

*Primary Examiner*—Marlon T. Fletcher

(57) ABSTRACT

A method for the creation and playback of recording industry music and audio, such that each time a composition is played back, a unique audio version is generated in the manner previously defined by the recording artist.

During composition creation, the artist's definition of how the composition will vary from playback to playback is embedded into the composition data set. During playback, the composition data set is processed on a playback device by a specific playback program the artist specified, so that each time the composition is played back a unique version is generated.

Variability occurs during playback per the artist's composition data set, which specifies the spawning of group(s) from a snippet, the selection of a snippet from each group, editing of snippets, flexible and variable placement of snippets, and the mixing of multiple snippets to generate each time sample in a channel.

60 Claims, 17 Drawing Sheets

Figure 17.

| Disadvantage | Overcome by |
|---|---|
| Composition definition is larger to store and download. | Storage & bandwidth cost decreasing at > 1.5x per year. |
| Requires more processing. | Processing costs decreasing by 1.5x per year. |
| Greater start-up delay. | Pipeline playback. Use faster processor. |
| Data is more sensitive to storage or bandwidth errors. | Sensitivity is similar to software. Use Error correction. |
| More effort for artists to create a composition. | Use visually driven composition creation software. |
| Artist's snippets could be used by others without authorization. | Use encryption. |

PSEUDO-LIVE MUSIC AUDIO AND SOUND

COPYRIGHT STATEMENT

© Copyright 2001 James W. Wieder.

A portion of this patent document contains material subject to copyright protection. The copyright owner has no objections to the facsimile reproduction of the document in the exact form it appears in the Patent and Trademark Office documents, but otherwise reserves all other copyrights whatsoever.

FEDERALLY SPONSORED RESEARCH

Not Applicable.

SEQUENCE LISTING OR PROGRAM

Not Applicable.

BACKGROUND

1. Field of Invention

This invention relates to music, specifically to the creation and playback of recording-industry music and audio, such that each time a composition is played back a unique version is generated, in a manner defined by the artist.

2. Prior Art

Current methods for the creation and playback of recording-industry music are fixed and static. Each time a recording artist's composition is played back, it sounds essentially identical.

Since Thomas Edison's invention of the phonograph, much effort has been expended on improving the exactness of "static" recordings. Examples of static music in use today include the playback of music on records, analog and digital tapes, compact discs, DVD's and MP3. Common to all these approaches is that on playback, the listener is exposed to the same audio experience every time the composition is played.

A significant disadvantage of static music is that listeners strongly prefer the freshness of live performances. Static music falls significantly short compared with the experience of a live performance.

Another disadvantage of static music is that compositions often lose their emotional resonance and psychological freshness after being heard a certain number of times. The listener ultimately loses interest in the composition and eventually tries to avoid it, until a sufficient time has passed for it to again become psychologically interesting. To some listeners, continued exposure, could be considered to be offensive and a form of brainwashing. The number of times that a composition maintains its psychological freshness depends on the individual listener and the complexity of the composition. Generally, the greater the complexity of the composition, the longer it maintains its psychological freshness.

Another disadvantage of static music is that a recording artist's composition is limited to a single fixed and unchanging version. The recording artist is unable to incorporate spontaneous creative effects associated with live performances into their static compositions. This imposes is a significant limitation on the creativity of the recording artist compared with live music.

And finally, "variety is the spice of life". Nature such as sky, light, sounds, trees and flowers are continually changing through out the day and from day to day. Fundamentally, humans are not intended to hear the same identical thing again and again.

The inventor is not aware of prior art that has attempted to include artist-defined variability into the playback of recording artist music and audio compositions. The following is a discussion of the prior art that have employed techniques to reduce the repetitiveness of music instruments or sound effects. None of this prior art discusses the applicability to artist-defined variability in the playback of recording industry compositions.

U.S. Pat. No. 4,787,073 by Masaki describes a method for randomly selecting the playing order of the songs on one or more storage disks. The disadvantage of this invention is that it is limited to the order that songs are played. When a song is played it always sounds the same.

U.S. Pat. No. 5,350,880 by Sato describes a keyboard instrument to allow a user to create music. A fixed stored sequence of tones (individual notes) can be played back automatically by the keyboard instrument. A method of varying the sound of a tone, each time it is played, is described. Some of the disadvantages of this invention are: 1.) The invention is limited to tones. 2.) The sequence of tones played is always the same. 3.) The musical quality and complexity is limited since the tones are limited to those synthetically generated from a set of tone parameters 4) The music is generated by synthetic methods which is significantly inferior to humanly created musical compositions 5) Recording artist creativity and control is not embedded in the process.

U.S. Pat. No. 6,121,533 by Kay describes a musical instrument capable of generating musical sound effects. Some of the disadvantages of this invention are 1) It is a musical instrument 2) Human interaction is needed to operate the instrument 3) The tones and notes are represented as data parameters that drive a synthesizer 4) The invention is limited to sequences of synthetic tones or notes 5) The sound is generated by synthetic methods which is significantly inferior to humanly created musical compositions. 6) Recording artist creativity and control is not embedded in the process.

U.S. Pat. No. 6,230,140 (and related U.S. Pat. Nos. 5,832,431, 5,633,985 and 5,267,318) by Severson, et al describes methods for generating continuous sound effects. The sound segments are played back, one after another to form a long and continuous sound effect. Many of the disadvantages of this invention are related to sound effects being significantly simpler than recording industry compositions. Additional disadvantages arise due to the use of randomness in the selection of groups, in-order to allow continuing reuse of sound segments and thereby reduce storage memory. Some disadvantages of this invention are: 1) Recording artists would not have enough control of the playback results because of the excessive unpredictability in the selection of groups 2) No provision for multiple channels 3) No provision for inter-channel dependency or complimentary effects between channels 4) A simple concatenation is used, one segment follows another segment 5) Concatenation only occurs at segment boundaries 6) There is no mechanism to position and overlay segments finely in time 7) No provision for synchronization and mixing of multiple tracks.

U.S. Pat. No. 5,315,057 by Land, et al describes a system for dynamically composing music in response to events and actions during interactive computer/video games. Some disadvantages of this invention are: 1) The sound is generated by synthetic methods which is significantly inferior to humanly created musical compositions 2) Recording artist creativity and control is not embedded in the process 3) Decisions based on real time inputs.

Another group of prior art deals with the creation and synthesis of music compositions automatically by computer or computer algorithm. An example is U.S. Pat. No. 5,496,962 by Meier, et al. A very significant disadvantage of this type approach is the reliance on a computer or algorithm that is somehow infused with the creative, emotional and psychological understanding equivalent to that of recording artists. A second disadvantage is that the recording artist has been removed from the process, without ultimate control over the creation that the listener experiences. Additional disadvantages include the use of synthetic means and the lack of artist participation and experimentation during the creation process.

All of this prior art has significant disadvantages and limitations, largely because these inventions were not directed toward the creation and playback of recording-industry compositions that are unique on each playback.

SUMMARY

A method for the creation and playback of recording industry music and audio, such that each time a composition is played back, a unique audio version is generated in the manner previously defined by the recording artist.

During composition creation, the artist's definition of how the composition will vary from playback to playback is embedded into the composition data set. During playback, the composition data set is processed on a playback device by a specific playback program the artist specified, so that each time the composition is played back a unique version is generated.

SUMMARY

Objects and Advantages

Accordingly, several objects and advantages of my invention over the "static" playback methods in use today include:

1.) Each time a recording artist's composition is played back, a unique musical version is generated.
2.) The composition is embedded with the artist's definition of how the composition varies from playback to playback.
3.) Allows the artist to create a composition that more closely approximates live music.
4.) Provides new creative dimensions to the recording artist via playback variability.
5.) Allows the artist to use playback variability to increase the depth of the listener's experience.
6.) Increases the psychological complexity of a recording artist's composition.
7.) Allows listeners to experience psychological "freshness" over a greater number of playbacks. Listeners are less likely to become tired of a composition.
8.) Playback variability can be used as a teaching tool (for example, learning a language or music appreciation).

Several objects and advantages of my invention over the prior art music instruments and sound effects include:

9.) The recording artist has complete control over the music generated on playback. The artist has complete control of the nature of the "aliveness" in their creation. (it's not randomly generated).
10.) Human artists create the music through experimentation and creativity (it's not synthetically generated).
11.) The composition definition contains the artist's definition of the playback variability.
12.) Generates multiple channels (e.g., stereo or quad).
13.) Artist can create complementary variability effects across multiple channels.
14.) During playback, variable selection and mixing of multiple tracks occurs in the manner defined by the artist.
15.) During playback, variable special effects editing may be performed.
16.) Compatible with the studio recording process used by today's recording industry.
17.) Compatible with the special effects editing used by today's recording industry.
18.) Does not require listener action to obtain the "aliveness" during playback.
19.) New and improved playback programs can be continually accommodated without impacting previously released pseudo-live compositions (backward compatibility).
20.) Allows simultaneous advancement in two different areas of expertise:
   a) the creative use of a playback program by artists.
   b) the advancement of the playback programs by technologists.

Other objects and advantages of my invention include:

21.) Each composition definition is digital data of fixed and known size in a known format.
22.) The composition data and playback program can be stored and distributed on any conventional digital storage mechanism (such as disk or memory) and can be broadcast or transmitted across networks (such as, airwaves, wireless networks or Internet).
23.) Pseudo-live music can be played on a wide range of hardware and systems including dedicated players, portable devices, personal computers and web browsers.
24.) The playback device can be located near the listener or remotely from the listener across a network or broadcast medium.
25.) The composition data format allows software tools to be developed to aid the artist in the composition creating process.

Additional objects and advantages of my invention due to optional enhancements to the invention include:

26.) Pseudo-live playback devices can be configured to playback both existing "static" compositions and pseudo-live compositions. This facilitates a gradual transition by the recording industry from "static" recordings to "pseudo-live" compositions.
27.) It is possible to optionally default to a fixed unchanging playback that is equivalent to the conventional "static" music playback.
28.) Playback processing can be pipelined so that playback may begin before all the composition data has been downloaded or processed.
29.) Playback music can adapt to characteristics of the listener's playback system (for example, number of speakers, stereo or quad system, etc).
30.) The artist may also control the amount of variability as a function of elapsed calendar time since composition release (or the number of times the composition has been played back). For example, no or little variability immediately following a composition's initial release, but increased variability after several months.
31.) The listener's system may include a variability control, which can be adjusted from no variability (i.e., the fixed default version) to the full variability defined by the recording artist in the composition definition.

Although the above discussion is directed to the creation and playback of recording industry music and audio, it may also be applied to any other type of audio creation. Further objects and advantages of my invention will become apparent from a consideration of the drawings and ensuing description.

BRIEF DESCRIPTION OF THE DRAWINGS

FIG. 17 lists the disadvantages of pseudo-live music versus static music, and shows how each of these disadvantages can be overcome.

DETAILED DESCRIPTION

Glossary of Terms

The following definitions may be helpful:

Composition: An artist's definition of the sound sequence for a single song. A static composition generates the same sound sequence every playback. A pseudo-live composition generates a different sound sequence, in a manner the artist defined, each time it is played back.

Channel: One of an audio system's output sound sequences. For example, for stereo there are two channels: stereo-right and stereo-left. Another example is the four quadraphonic channels. In pseudo-live compositions, a channel is generated during playback by mixing together multiple tracks.

Snippet: A sound sequence of time sample values, combined with variability parameters and the ability to spawn groups. A snippet includes edit variability parameters and placement variability parameters. A snippet also may spawn any number of other groups at different locations in the same channel or in other channels. A snippet may represent a time slice of studio-mixed instruments and voices, or a time slice of one instrument or voice. During playback, many snippets are mixed together to form each channel. A fraction of all the snippets in a composition data set are used in any given playback.

Group: A set of 1 or more snippets for possible insertion at specific location(s) in a composition. Each group includes a snippet selection method that defines how one snippet in the group is selected whenever the group is processed during playback. A group may or may not be used in any given playback.

Spawn: To initiate the processing of a specific group and the insertion of one of it's processed snippets at a specified location in a specified channel. Each snippet, defined by the artist, can spawn any number of groups. Spawning allows the artist to have complete control of the unfolding use of groups in the composition playback. Note that the sequence of groups used is not randomly or statistically determined, because this would result in excessive variability and incomplete artistic control over the composition playback.

Artist(s): Includes the recording artists, musicians, producers, recording and editing personnel and others involved in the creation of a composition.

Existing Recording Industry Overview

Figure 1:
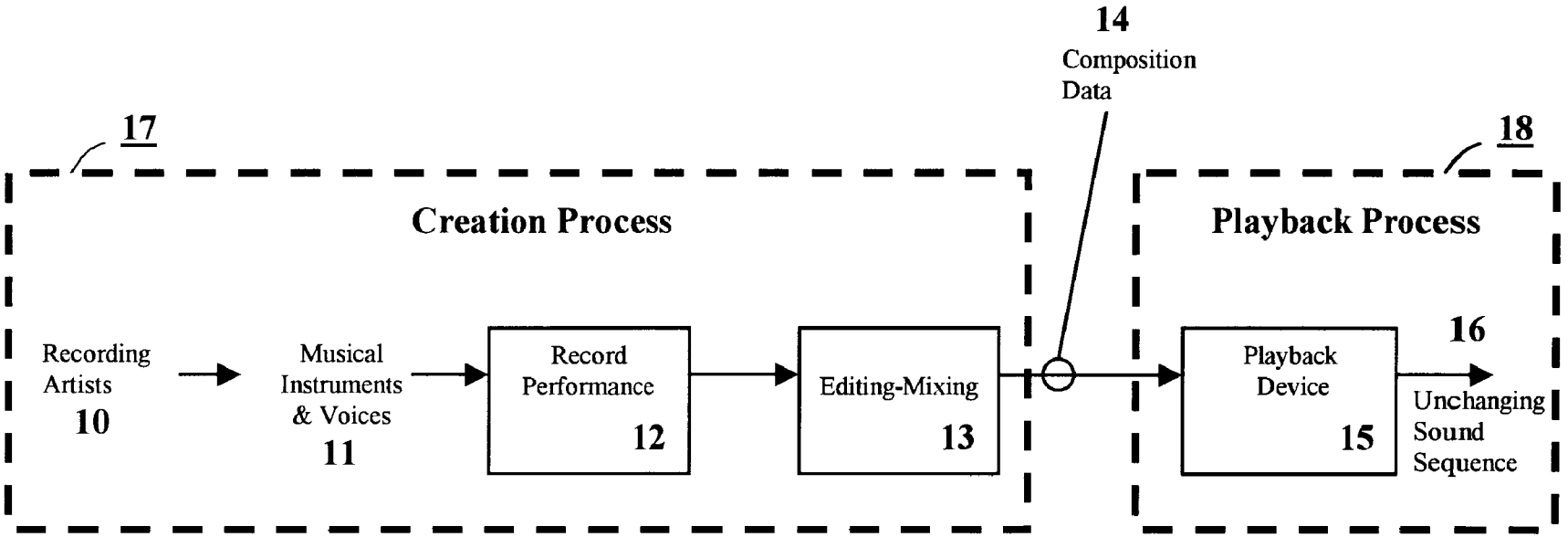
Figure 1. Prior Art
FIG. 1 is an overview of the composition creation and playback process for static music (prior-art).

FIG. 1 is an overview of the music creation and playback currently used by today's recording industry (prior art). With this approach, the listener hears the same music every time the composition is played back. A "composition" refers to a single song, for example "Yesterday" by the Beatles. The music generated is fixed and unchanging from playback to playback.

As shown in FIG. 1, there is a creation process 17, which is under the artist's control, and a playback process 18. The output of the creation process 17 is composition data 14 that represents a music composition (i.e., a song). The composition data 14 represents a fixed sequence of sound that will sound the same every time a composition is played back.

The creation process can be divided into two basic parts, record performance 12 and editing-mixing 13. During record performance 12, the recording artists 10 perform a music composition (i.e., song) using multiple musical instruments and voices 11. The sound from of each instrument and voice is separately recorded onto one or more tracks. Multiple takes and partial takes may be recorded. Additional overdub tracks are often recorded in synchronization with the prior recorded tracks. A large number of tracks (24 or more) are often recorded.

The editing-mixing 13 consists of editing and then mixing. The editing consists of enhancing individual tracks using special effects such as noise compensation, echo, delay, reverb, fade, phasing, gated reverb, delayed reverb, phased reverb or amplitude effects. In mixing, the edited tracks are equalized and blended together, in a series of mixing steps, to fewer and fewer tracks. Ultimately stereo channels representing the final mix (e.g., the master) are created. All steps in the creation process are under the ultimate control of the recording artists. The master is a fixed sequence of data stored in time sequence. Copies for distribution in various media are then created from the master. The copies may be optimized for each distribution media (tapes, CD, etc) using storage/distribution optimization techniques such as noise reduction or compression (e.g., analog tapes), error correction or data compression.

During the playback process 18, the playback device 15 accesses the composition data 14 in time sequence and the storage/distribution optimization techniques (e.g., noise reduction, noise compression, error correction or data compression) are removed. The composition data 14 is transformed into the same unchanging sound sequence 16 each time the composition is played back.

Overview of the Pseudo-Live Music & Audio Process (This Invention)

Figure 2:
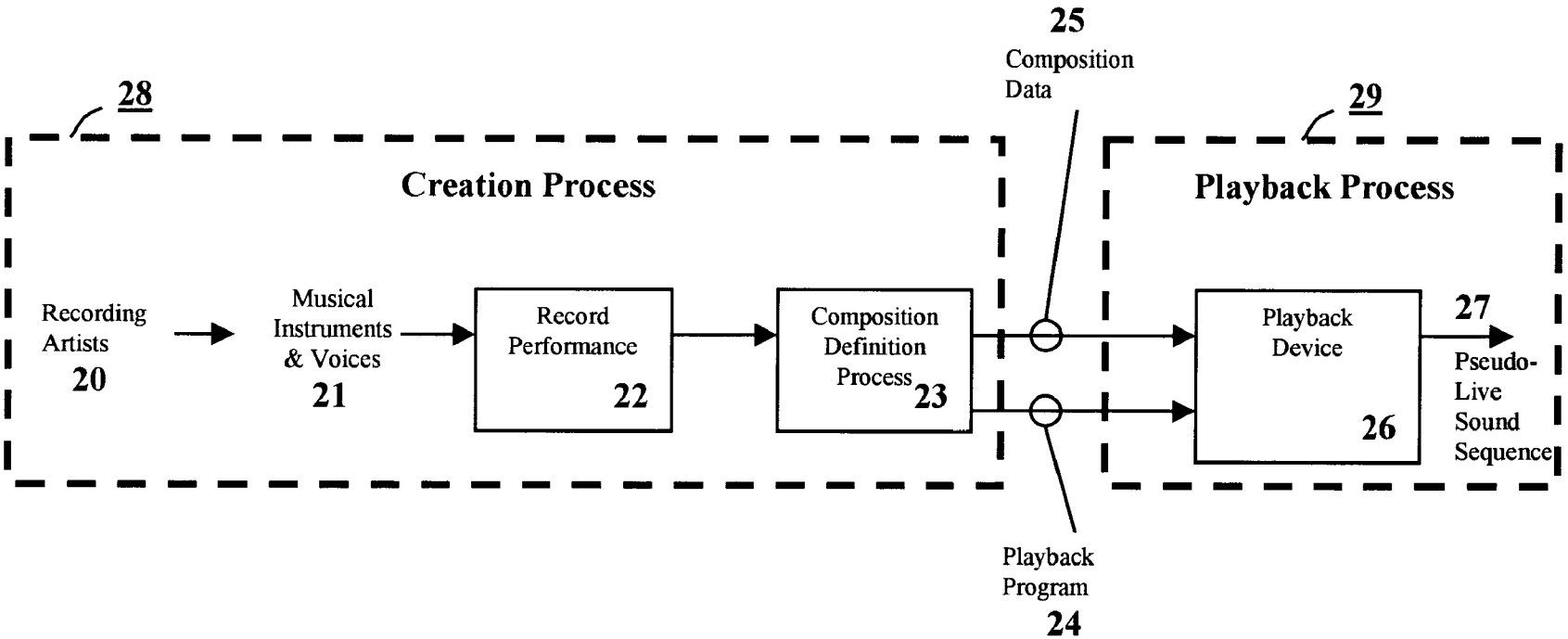
FIG. 2 is an overview of the composition creation and playback process for pseudo-live music and audio.

FIG. 2 is an overview of the creation and playback of Pseudo-Live music and audio (this invention). With this invention, the listener hears a unique version each time a composition is played back. The music generated changes from playback to playback by performing both editing and mixing during the playback process per the artist's definition. With this invention, the artist has complete control over the playback variability.

As shown in FIG. 2, there is a creation process 28 and a playback process 29. The output of the creation process 28 is the composition data 25 and a corresponding playback program 24. The composition data 25 contains the artist's definition of a pseudo-live composition (i.e., a sang). The artist's definition of the variable editing and mixing performed from playback to playback is embedded in the composition data 25. Each time a playback occurs, the playback device 26 executes the playback program 24 to process the composition data 25 such that that a different pseudo-live sound sequence 27 is generated. The artist maintains complete control of the playback editing-mixing via information contained within the composition data 25 that was defined in the creation process.

The composition data 25 is unique for each artist's composition. The same playback program 24 is expected to used for many different compositions, but if desired a playback program can be dedicated to a single composition. At the start of the composition creation process, the artist chooses a specific playback program 24 to be used for a composition, based upon the desired variability techniques the artist wishes to employ in the composition.

It is expected that the playback programs will advance over time with both new versions and alternative programs, driven by recording artist requests for additional variability techniques. Over a period of time, it is expected the recording industry will utilize multiple playback programs, each with several different versions. Embedded in the composition data 25 are parameters that identify the specific version of the playback program 24 to be used to process the composition data 25. This allows playback program advancements to occur while maintaining backward compatibility with earlier pseudo-live compositions.

As shown in FIG. 2, the creation process 28 consists of record performance 22 and composition definition process 23. The record performance 22 is very similar to that used by today's recording industry (shown in FIG. 1 and described in the previous section above). The main difference is that the record performance 22 for this invention (FIG. 2) will typically require that many more overdub tracks be recorded. These additional overdub tracks are ultimately utilized in the creation process as a source of variability during playback.

The composition definition process 23 for this invention (FIG. 2) is more complex and has additional steps compared with the edit-mixing block 13 shown in FIG. 1. The output of the composition definition process 23 is composition data 25. During the composition definition process, the artist embeds the definition of the playback variability into the composition data 25. The composition data 25 has a specific format recognized by a specific playback program 24.

The artist specifies variability by defining the control parameters for the following variability methods utilized during playback:

1.) Snippets representing a sound sequence from one instrument or voice.
2.) Selecting among a group of snippets per a selection method defined for each group.
3.) Special effects editing of each snippet (optional enhancement).
4.) Inter-channel special effects editing (optional enhancement).
5.) Spawning other groups of snippets from a snippet.
6.) Spawning groups in other channels.
7.) Flexible placement of each group relative to the spawning snippet.
8.) Variability in the placement of each snippet (optional enhancement).
9.) Mixing of multiple snippets to generate each time sample.

This invention can be enhanced to allow other methods of variability to be added if recording artists express a need. An artist may not need to utilize all of the above variability methods for a particular composition. If an artist desires, the length of the composition can vary from playback to playback, via the different lengths of the snippets selected, the differing number of snippets spawned or how the snippets are placed.

A very simple pseudo-live composition may utilize a fixed unchanging base track for each channel for the complete duration of the song, with additional instruments and voices variably selected and mixed onto this base. In a more complex pseudo-live composition, the duration of the composition varies with each playback based upon the selection of snippets from groups and the spawning of other groups. In even more complex pseudo-live compositions, many (or all) of the variability methods listed above are simultaneously used. In all cases, how a composition varies from playback to playback is under the complete control of the artist.

Note that the selection between alternative snippets causes in a significant increase in the amount of data contained in a composition data set. This selection between alternative snippets is intended to expand the listener's experience. Note that, this invention is not trying to reduce the amount of composition data by reusing snippets throughout a playback.

Note that the selection between alternative snippets causes a significant increase in the amount of data contained in a composition data set. This selection between alternative snippets is intended to expand the listener's experience. Note that, this invention is not trying to reduce the amount of composition data by reusing snippets throughout a playback.

During the creation phase, the artist experiments with and chooses the editing and mixing variability to be generated during playback. Only those editing and mixing effects that are needed to generate playback variability are used in the playback process. It is expected that the majority of the special effects editing and much of the mixing will continue to be done in the studio during the creation process.

Composition Definition Process

Prior to starting the composition definition process, the artist must choose the specific playback program, to be used during the playback of the composition. It is expected there will ultimately be various playback programs available to artists, with each program capable of utilizing a different set of playback variability techniques. The artist chooses the playback program based on the creative effects they desire for their composition. Once the program is chosen, it is expected that visually driven software, optimized for the chosen playback program, will assist the artist during the composition definition process.

Figure 3:
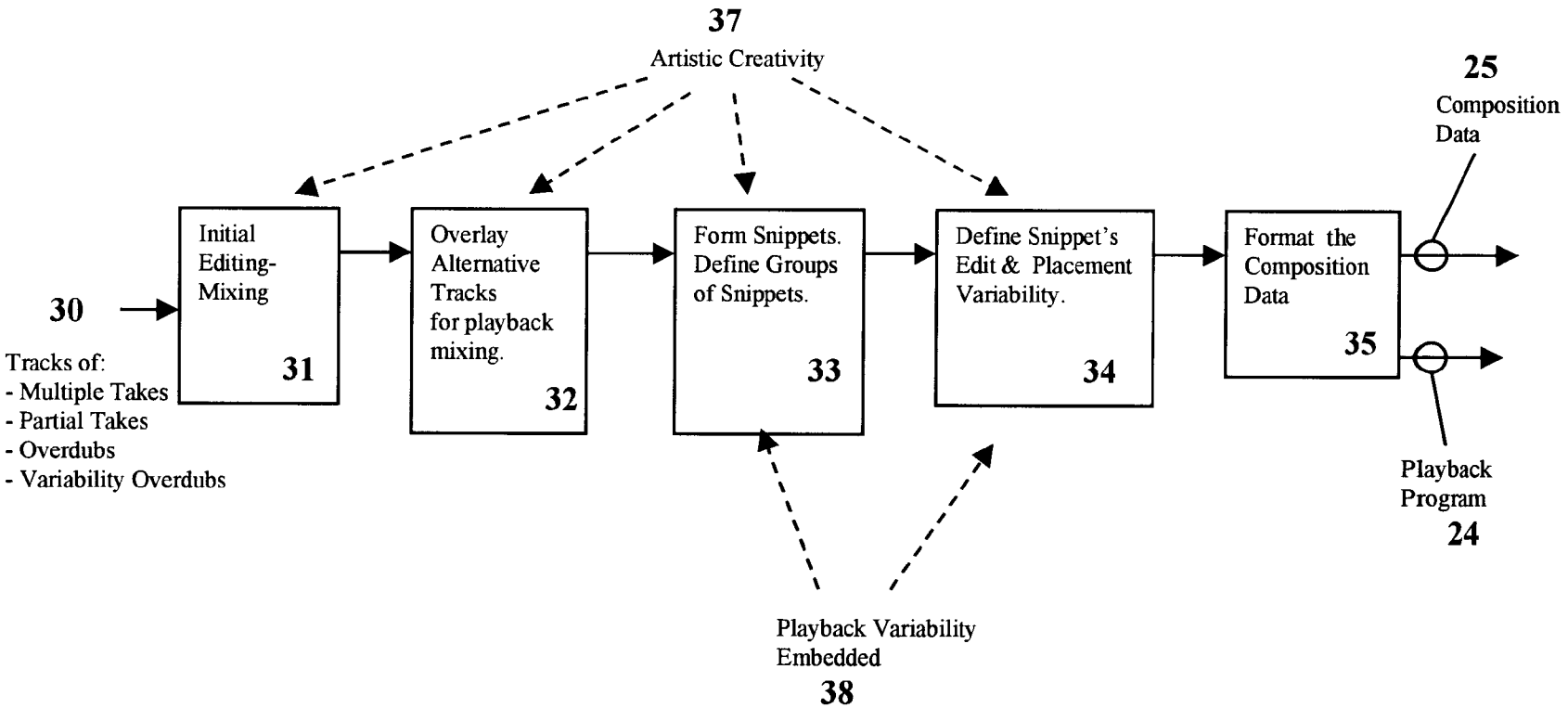
FIG. 3 is a flow diagram of the composition definition process (creation).

FIG. 3 is a flow diagram detailing the "composition definition process" 23 shown in FIG. 2. The inputs to this process are the tracks recorded in the "record performance" 22 of FIG. 2. The recorded tracks 30 include multiple takes, partial takes, overdubs and variability overdubs.

As shown in FIG. 3, the recorded tracks 30 undergo an initial editing-mixing 31. The initial mixing-editing 31 is similar to the editing-mixing 13 block in FIG. 1, except that in the FIG. 3 initial editing-mixing 31 only a partial mixing of the larger number of tracks is done. Another difference is that different variations of special effects editing may be used to create additional overdub tracks, additional tracks that will be variably selected during playback. At the output of the initial editing-mixing 31, a large number of partially mixed tracks and variability overdub tracks are saved.

The next step 32 is to overlay alternative tracks for playback mixing. In step 32, the partially mixed tracks and variability overdub tracks are synchronized in time. Various alternative combinations of tracks are experimented in various mixing combinations. The artist creates and chooses various alternate combinations to be used in playback mixing.

The next step 33 is to form snippets and to define groups of snippets. First the synchronized tracks are sliced into snippet sound segments (a sequence of time sample values). Snippet sound sequences may represent a studio mixed combination of several instruments and/or voices. In some cases, a snippet sound sequence may represent only a single instrument or voice.

A snippet also may spawn any number of other groups at different locations in the same channel or in other channels. A group is a set of one or more snippets that attach at the same place in a spawning snippet. During a playback, when a group is used then one of the snippets in the group is inserted based on the selection method specified by the recording artist. Based on the results of artist experimentation with various variability overdubs, all snippets that are to be inserted at the same time location are defined as a group by the artist. The method to be used to select between the snippets in each group during playback is also chosen by the artist in step 33.

The next step 34 is to define the snippet's edit variability & placement variability. Based on artist experimentation, the optional special effects editing to be performed on each snippet during playback is chosen by the artist. Edit variability parameters are used to specify how special effects (for example, echo, reverb or amplitude) are to be varyingly applied to the snippet during playback processing. Similarly, based on artist experimentation, the optional placement variability of placing each snippet during the playback is chosen by the artist. Placement variability parameters are used to specify how spawned snippets are placed in a varying way from their nominal location during playback processing.

The final step 35 is to package the composition data, into the format that can be processed by the specific the playback program 24. Throughout the composition definition process, the artists are experimenting and choosing the variability that will be used during playback. Note that artistic creativity 37 is embedded in steps 31 through 34. Playback variability 38 is embedded in steps 33 and 34 under artist control.

Defining a Group of Snippets (Composition Creation Process)

Figure 4:
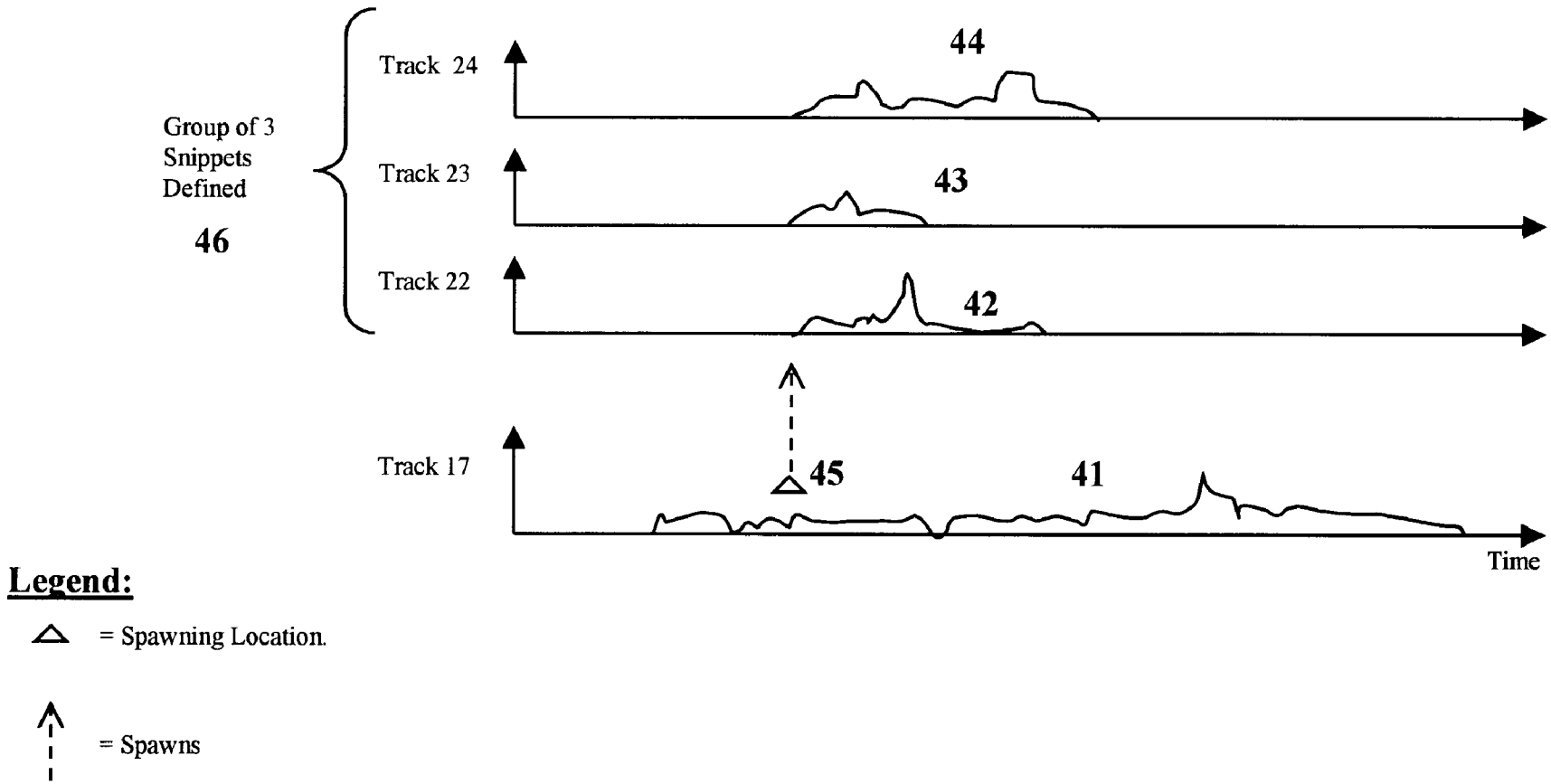
FIG. 4 is an example of defining a group of snippets during the composition definition process (creation).

FIG. 4 is a detailed example of how a group of snippets are defined in block 33 of FIG. 3. Four tracks containing snippets are shown in FIG. 4. Each snippet was formed earlier in block 33 of FIG. 3, by time slicing the recorded track data. In the example in FIG. 4, the artist creates variability during playback by defining the selection of 1 of 3 snippets (42, 43, 44) to be mixed with spawning snippet 41. The artist also defines the selection method to be used to chose among the three snippets during playback. A typical selection method is an equally probable random selection. The "spawning location" 45 in the spawning snippet 41 defines where the selected snippet from the spawned group of 3 snippets 46 is to nominally attach during playback.

Format of Composition Data

Figure 5:
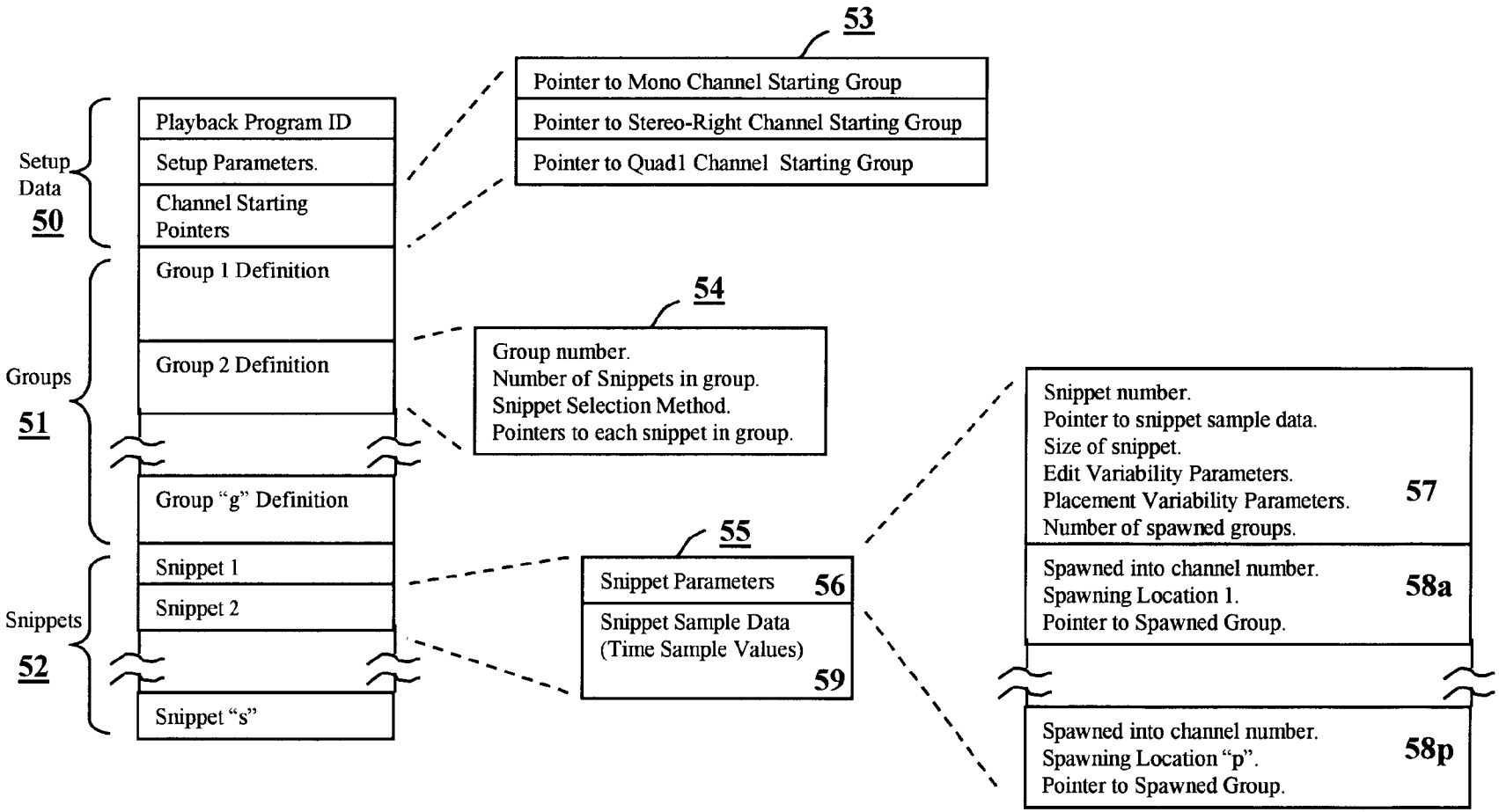
FIG. 5 details the format of the composition data.

FIG. 5 shows details of the format of the composition data 25. The composition data 25 has a specific format, which is recognized by a specific playback program 24. The amount of data in the composition data format will differ for each composition but it is a known fixed amount of data that is defined by the composition creation process.

The composition data are a fixed, unchanging, set of digital data (e.g., bits or bytes) that are a digital representation of the artist's composition. The composition data can be stored and distributed on any conventional digital storage mechanism (such as disks, tape or memory) as well as broadcast through the airwaves or transmitted across networks (such as the Internet).

If desired the composition data 25 can be stored in a compressed form by the use of a data compression program. Such compressed data would need to be decompressed prior to being used by the playback program 24.

In-order to allow great flexibility in composition definition, pointers are used throughout the format structure. A pointer holds the address or location of where the beginning of the data pointed to will be found. Pointers allow specific data to be easily found within packed data elements that have arbitrary lengths. For example, a pointer to a group holds the address or location of where the beginning of a group definition will be found.

As shown in FIG. 5, the composition data 25 consists of three types of data:

1.) Setup data 50

2.) Groups 51

3.) Snippets 52.

The setup data 50 includes data used to initialize and start the playback process. The setup data 50 is composed of a playback program ID, setup parameters and channel starting pointers.

The playback program ID indicates the specific playback program and version to be used during playback to process the composition data. This allows the recording industry to utilize and advance playback programs while maintaining backward compatibility with earlier pseudo-live compositions.

The setup parameters include a definition of the channel types that can be created by this composition (for example, mono, stereo or quad) and other playback setup parameters (such as "max placement variability" and playback pipelining setup parameters).

The channel starting pointers (shown in block 53) point to the starting group to be used for the starting channel for mono, stereo and quad channel types. Each playback device indicates, the specific channel types it desires. The playback program begins processing only the starting group corresponding to the channel types requested by the playback device. The remaining channels, (e,g., in stereo or quad), are created by spawning a group into each of the other channels.

During playback, the unfolding of events in one channel is usually not arbitrary or independent from other channels.

Often what is happening in one channel may need to be dependent on what occurs in another channel. Spawning groups into other channels allows the specification of cross channel dependency and allows variable complementary channel effects. For example, for a stereo playback device, the program begins with the stereo-right channel, starting group. The stereo left channel, starting group is spawned from the stereo right channel, so that the channels may have the artist desired channel dependency. Note that for the stereo channel example, the playback program only generates the two stereo channels desired by the playback device (and the mono and quad channels would not be generated).

The groups 51 consist of "g" group definitions. Any number of groups may be used and the number used will be unique for each artist's composition. The size of each group definition may be different. If the artist desires, a group can be used multiple times in a chain of spawned snippets. A group may be used in as many different chains of spawned snippets as the artist desires.

Referring to FIG. 5, block 54 details the contents of each group definition. The group definition parameters and their purposes are:

1.) "Group number" is a group ID.

2.) Number of snippets in the group. Used to identify the end of the snippet pointers.

3.) Snippet selection method. The snippet selection method defines how one snippet in the group is to be selected each time the group is used during playback. The selection method to be used for each group is defined by the artist. Typically, snippets in a group are selected with the same probability but other distributions can be employed.

4.) Pointers to each snippet in the group. Allows the start of each snippet to be found.

The snippets 52 consist of "s" snippets. Any number of snippets may be used and the number used will be unique for each artist's composition. A snippet definition may be any length and each snippet definition will typically have a different length. If the artist desires, the same snippet can be used in different groups of snippets. The total number of snippets ("s") needed for a single composition, of several minutes duration, can be quite large (100's to 100,000's or more) depending on the artist's definition (and whether optional pipelining, as described later, is used).

Block 55 details the contents of each snippet. Each snippet includes snippet parameters 56 and snippet sample data 59. The snippet sample data 59 is a sequence of time sample values representing a portion of a track, which is to be mixed into an output channel during playback. Typically, the time samples represent amplitude values at a uniform sampling rate. Note that an artist can optionally define a snippet with time sample values of all zeroes, yet the snippet can still spawn groups.

Referring to FIG. 5, the snippet parameters 56 consist of snippet definition parameters 57 and "p" spawned group definitions (58*a* and 58*p*).

The snippet definition parameters 57 and their purpose are as follows:

1.) The "snippet number" is a snippet ID.

2.) The "pointer to the start of data" allows the start of "snippet sample data" to be found.

3.) The "size of snippet" is used to identify the end of the snippet's sample data.

4.) The "edit variability parameters" specify special effects editing to be done during playback. Edit variability parameters are used to specify how special effects (such as echo, reverb or amplitude effects) are to be varyingly applied to the snippet during playback processing. Use of edit variability is optional for any particular artist's composition. Note that, many of the edit variability effects can be alternately accomplished by an artist by using more snippets in each group (where the edit variability processing was done during the creation process and stored as additional snippets to be selected from a group).

5.) The "placement variability parameters" are used to specify how spawned snippets are placed in a varying way from nominal during playback processing. Placement variability also allows the option of using or not using a snippet in a variable way. Use of placement variability is optional for any particular artist's composition. Note that, many of the placement variability effects can be alternately accomplished by using more snippets in each group (where the placement variability processing was done during the creation process and stored as additional snippets to be selected from a group).

6.) The number of spawned groups is used to identify the end of the "p" spawned group definitions.

Each "spawned group definition" (58*a* and 58*p*) identifies the spawn of a group from the current snippet. "Spawn" means to initiate the processing of a specific group and the insertion of one of it's processed snippets at a specified location in a specified channel. Each snippet may spawn any number of spawned groups and the number spawned can be unique for each snippet in the artist's composition.

Spawning allows the artist to have complete control of the unfolding use of groups in the composition playback. Note that the groups used are not randomly or statistically selected, because this would result in excessive variability and incomplete artistic control over the composition playback.

Because of the use of pointers, there is no limit to the artist's spawning of snippets from other snippets. The parameters of the "spawned group definition" (58*a* and 58*p*) and their purpose are as follows:

1.) The "spawned into channel number" identifies which channel the group will be placed into. This parameter allows snippets in one channel to spawn snippets in any other channel. This allows the artist to control how an effect in one channel will result in a complementary effect in another channel.

2.) The "spawning location" identifies the time location in the snippet where a spawned snippet is to be nominally placed.

3.) The "pointer to spawned group" identifies which group of snippets the spawned snippet will come from.

Example of Placing & Mixing Snippets (Playback Processing)

Figure 6:
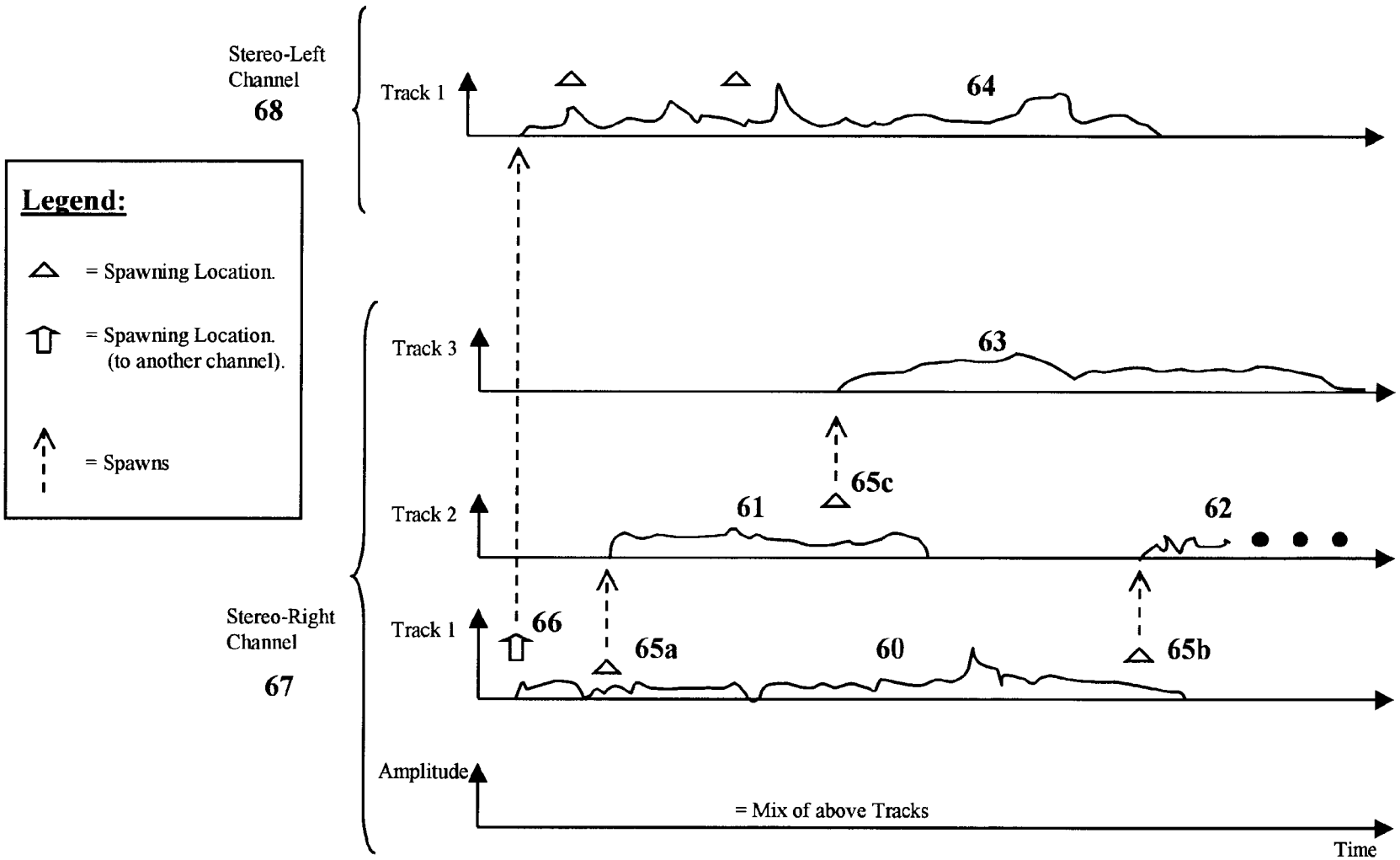
FIG. 6 is an example of the placing and mixing of snippets (playback).

FIG. 6 is an example of the placing and mixing of snippets during playback processing to generate stereo channels. This example illustrates the flexibility available in the spawning of groups and the placement of snippets. It is not intended to be representative of an actual composition.

Figure 8:
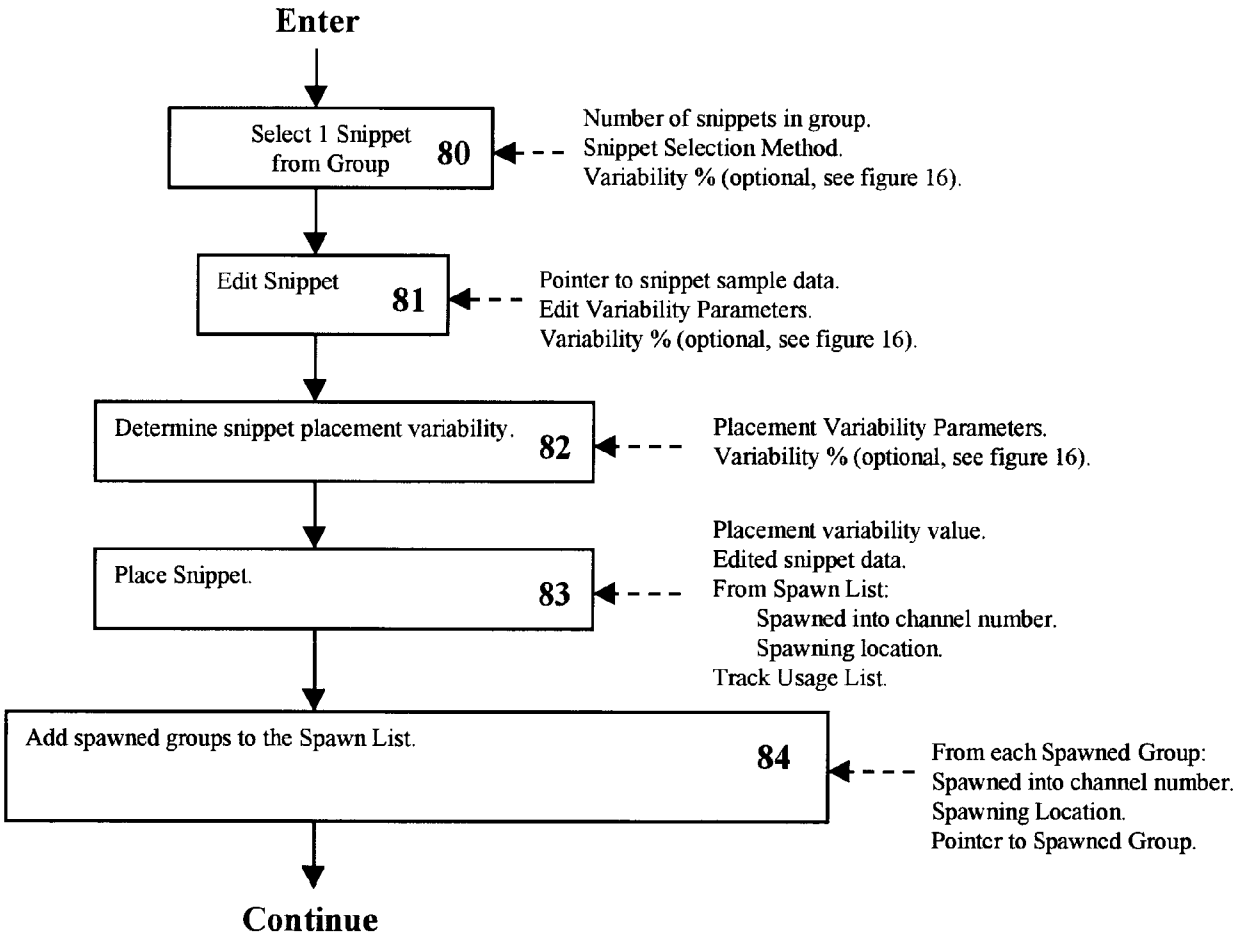
FIG. 8 is a flow diagram of the processing of a group definition and a snippet (playback).

The steps in FIG. 8, blocks 80 through 82 are performed before placing a snippet during playback:

1.) The snippet was selected from a group of snippets (80).

2.) The snippet was edited for special effects (81).

3.) The snippet placement variability from nominal was determined (82).

Note that each of these 3 steps is a source of variability that the artist may have chosen to utilize for a given composition. In order to simplify the example, snippet placement variability is not used in FIG. 6.

As shown in FIG. 6, the first snippet 60 to be placed, was selected from the "stereo-right channel starting group" defined in the composition data. Snippet 60 spawned 3 groups.

Snippet 60 spawned two groups in the same channel (stereo-right) at spawning locations 65*a* and 65*b*. Snippet 61 (selected from the artist specified spawned group) is placed into track 2 on the stereo-right channel at spawning location 65*a*. Similarly, snippet 62 (selected from another artist specified spawned group) is placed into track 2 on the stereo-right channel at spawning location 65*b*. Track 2 can be used for both snippets since they don't overlap. If these snippets overlapped, then snippet 62 would be placed into another track. Snippet 61 then spawns another group in the stereo-right channel at spawning location 65*c*. Snippet 63 (selected from yet another artist specified spawned group) is placed in track 3 of the stereo-right channel at spawning location 65*c*.

Snippet 60 also spawned a group in the stereo-left channel at spawning location 66. Snippet 64 (selected from the artist specified spawned group) is placed into track 1 on the stereo-left channel at spawning location 66. This is an example of how a snippet in one channel can spawn snippets in other channels. This allows the artists to control how an effect in one channel can cause a complementary effect in other channels. Note that, snippet 64 in the stereo-left channel may then spawn additional snippets for stereo-left and (possibly other channels) but for simplicity this is not shown.

Once all the snippets have been placed, the tracks for each channel are mixed (i.e., added together) to form the channel time samples representing the sound sequence. In the example of FIG. 6, the stereo-right channel is generated by the summation of stereo-right tracks 1, 2 and 3 (and any other stereo-right tracks spawned). Similarly, the stereo-left channel is generated by the summation of stereo-left track 1 (and any other stereo-left tracks spawned).

Note the following general capabilities:

1.) A snippet may spawn any number of other groups in the same channel.

2.) A snippet in one channel can also spawn any number of groups in other channels. This allows the artist to define complementary channel effects.

3.) Spawned snippets may spawn other snippet groups in an unlimited chain.

4.) The artist can mix together any number of snippets to form each channel.

5.) The spawning location can be located anywhere within a snippet. This provides great flexibility in placing snippets. We are not limited to simple concatenations of snippets.

6.) Any number of channels can be accommodated (for example, mono, stereo or quad).

7.) The spawning definitions are included in the parameters defining each snippet (see FIG. 5).

Playback Program Flow Diagram

Figure 7:
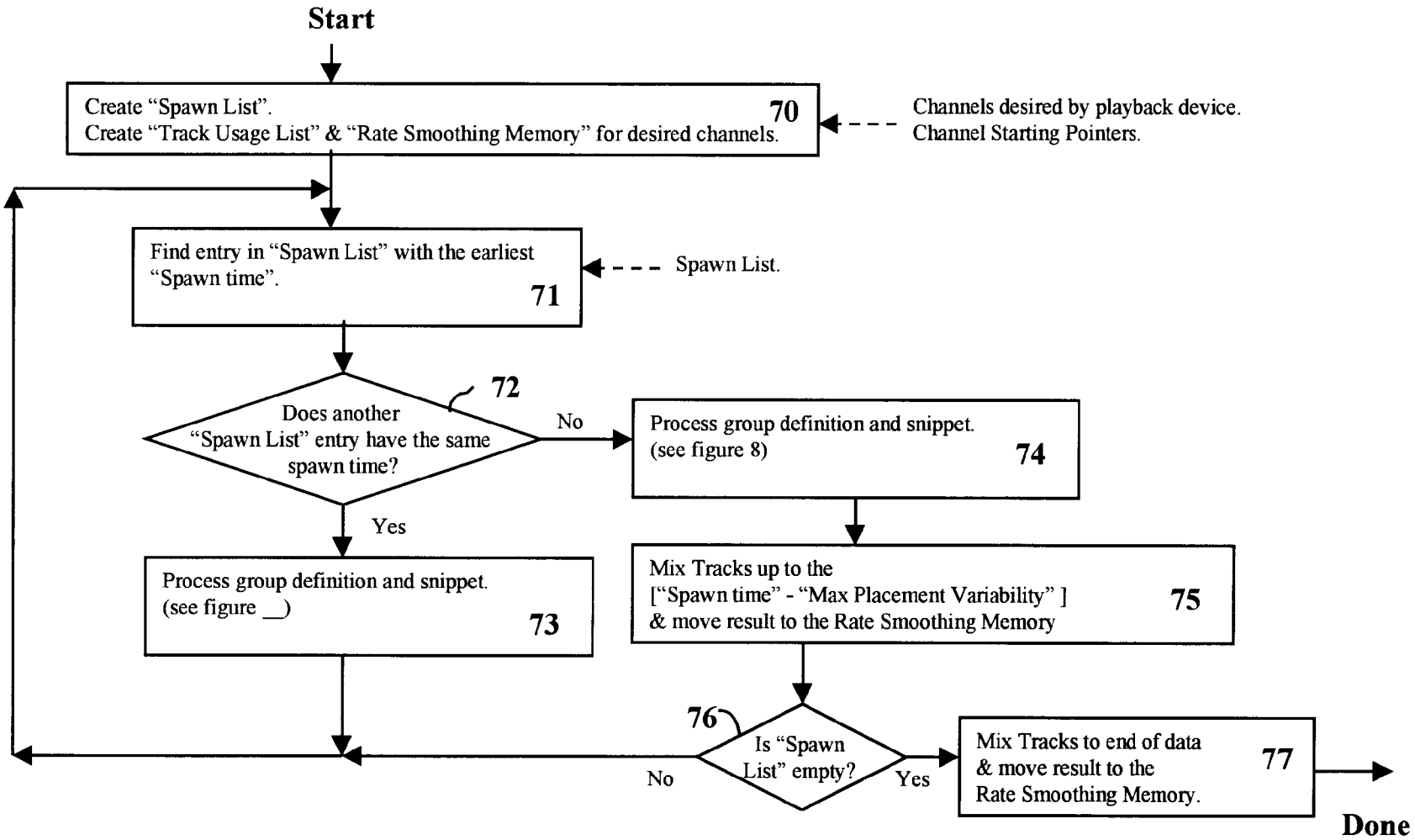
FIG. 7 is a flow diagram of the playback program.

A flow diagram of the playback program 24 is shown in FIG. 7. FIG. 8 provides additional detail of the "process group definition and snippet" blocks (73 and 74) of FIG. 7. The playback program processes the composition data 25 so that a different sound sequence is generated on each playback. Throughout the playback processing, working storage is utilized to hold intermediate processing results. The working storage elements are detailed in FIG. 9.

Playback processing begins with the initialization block 70 shown in FIG. 7. A "Track Usage List" and a "Rate smoothing memory" are created for each of the channels desired by the playback device. For example, if the playback device is a stereo device, then a "track usage list" (90*a* & 90*b*) and "rate smoothing memory" (91*a* & 91*b*) are created for both the stereo-right and stereo-left channels. The entries in these data structures are initialized with zero or null data where required. A single "spawn list" 92 is created to contain the list of spawned groups that will need to be processed. The "spawn list" 92 is initialized with the "channel starting pointer" corresponding to the channels desired by the playback device. For example, if the playback device is a stereo device then the "spawn list" is initialized with the "stereo-right starting group" at spawning location 0 (i.e., the start).

The next step 71 is to find the entry in the spawn list with the earliest "spawning location". The group with the earliest spawning location is always processed first. This assures that earlier parts of the composition are processed before later parts.

Next a decision branch occurs depending on whether there are other "spawn list" entries with the same "spawning location". If there are other entries with the same spawning location then "process group definition and snippet" 73 is performed followed by accessing another entry in the "spawn list" via step 71.

If there are no other entries with the same spawning location then "process group definition and snippet" 74 is performed followed by mixing tracks and moving results to the rate smoothing memory 75. The tracks are mixed up to the "spawn location" minus the "max placement variability", since no following spawned groups can now be placed before this time. The "max placement variability" represents the largest shift in placement before a snippets nominal spawn location.

Step 75 is followed by a decision branch 76, which checks the spawn list" to determine if it is empty or whether additional groups still need to be processed. If the "spawn list" still has entries, the "spawn list" is accessed again via step 71. If the "spawn list" is empty, then all snippets have been placed and step 77 can be performed, which mixes and moves the remaining data in the "track usage list" to the "rate smoothing memory". This concludes the playback of the composition.

Processing a Group Definition & Snippet (Playback Process)

FIG. 8 shows a flow diagram of the "process group definition and snippet" block 74 in FIG. 7, which is part of the playback process. In FIG. 8, the steps are shown in blocks 80 to 84, while the parameters (from the composition definition or working storage) used in each step are shown to the right of each block.

The first step 80 is to "select 1 snippet from group". The entry into this step, followed the spawning of a group at a spawning location. The selection of one snippet from a group of one or more snippets is accomplished by using the number of snippets in the group and the snippet selection method. Both of these parameters were defined by the artist and are in the "group definition" in the "composition data" (FIG. 5). A typical "snippet selection method" would be to select any one of the snippets in the group with the same likelihood. But the artist may utilize other non-uniform probability weightings. The "Variability %" parameter is associated with an optional enhancement to the basic embodiment. Basically, the "Variability %" limits the selection of the snippets to a fraction of the group. For example if the "Variability %" is set at 60%, then the snippet selection is limited to the first 60% of the snippets in the group, chosen according to the "snippet selection method". If the "Variability %" is set at 100%, then the snippet is selected from all of the snippets in the group. If the "Variability %" is set at 0%, then only the first snippet in the group is used and the composition will default to a fixed unchanging playback. The purpose of "Variability %" and how it's set is explained in a section below.

Once a snippet has been selected, the next step 81 is to "edit snippet" with a variable amount of special effects such as echo, reverb or amplitude effects. The amount of special effects editing, varies from playback to playback. The "pointer to snippet sample data" is used to locate the snippet data, while the "edit variability parameters" specify to the edit subroutine how the variable special effects will be applied to the "snippet sample data". The "Variability %" parameter functions similar to above. If the "Variability %" set to 0%, then no variable special effects editing is done. If the "Variability %" set to 100%, then the full range of variable special effects editing is done.

The next step 82 is to "determine snippet placement variability". The "placement variability parameters" are input to a placement variability subroutine to select a variation in placement of the snippet about the nominal spawning location. The placement variability for all snippets will should less then the "max placement variability" parameter defined in the setup data. The "Variability %" parameter functions similar to above. If the "Variability %" is set to 0%, then no placement variability is used. If the "Variability %" is set to 100%, then the full range of placement variability for the snippet is used.

The next step is to "place snippet" 83 into an open track for a specific channel. The channel is defined by the "spawned into channel number" shown in the "spawn list" (see FIG. 9). The placement location for the snippet is equal to the "spawning location" held in the "spawn list" plus the placement variability (if any) determined above. The usage of tracks for each channel is maintained by the "track usage list" (see FIG. 9). When a snippet is to be placed in the channel, the "track usage list" is examined for space in existing tracks. If space is not available in an existing track, another track is added to the "track usage list" and the snippet sample values are placed there.

The next step is to "add spawned groups to the spawn list" 84. The parameters in each of the spawned group definitions (58*a*, 58*p*) for the snippet are placed into the "spawn list". The "spawn list" contains the list of spawned groups that still need to be processed.

Working Storage (Playback Process)

Figure 9:
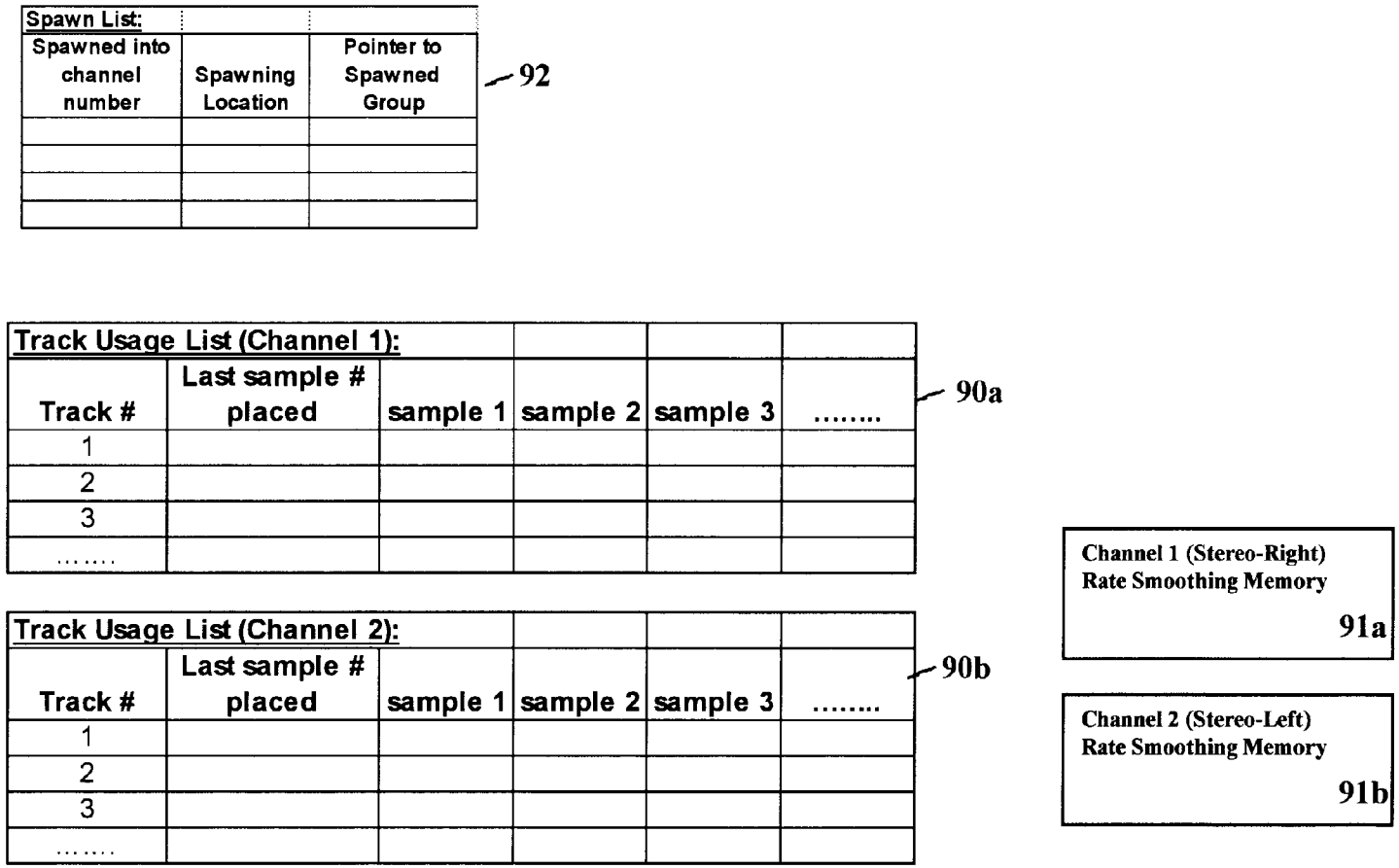
FIG. 9 is shows the details of working storage used by the playback program.

FIG. 9 shows the working storage data structures which hold intermediate processing results during the playback processing. FIG. 9 shows an example for a playback device with stereo channels. The data structures include:

1.) A "track usage list" (90*a* & 90*b*) for each channel desired by the playback device. The "track usage list" includes multiple rows of track data corresponding to the edited snippets that have been placed in time. Each row includes a "last sample # placed" to identify the next open space available in each track. A snippet is placed into an open space in an existing track. When no space is available in the existing tracks, an additional track is added to the list. The "track usage list" corresponds to the placement of edited snippets as shown in FIG. 6.

2.) A "rate smoothing memory" (91*a* & 91*b*) for each channel desired by the playback device. Mixed sound samples in time order are placed into the rate-smoothing memory in non-uniform bursts by the playback program. The output side of the rate-smoothing memory, is able to feed samples to the DAC & audio system at a uniform sampling rate.

3.) A single "spawn list" 92 used for all channels. The "spawn list" 92 holds the list of spawned groups that still need to be processed. The entry in the "spawn list" with the earliest spawning location is always processed first. This assures that groups that effect the earlier portion of a composition are processed first.

Block Diagram of a Pseudo-Live Playback Device

Figure 10:
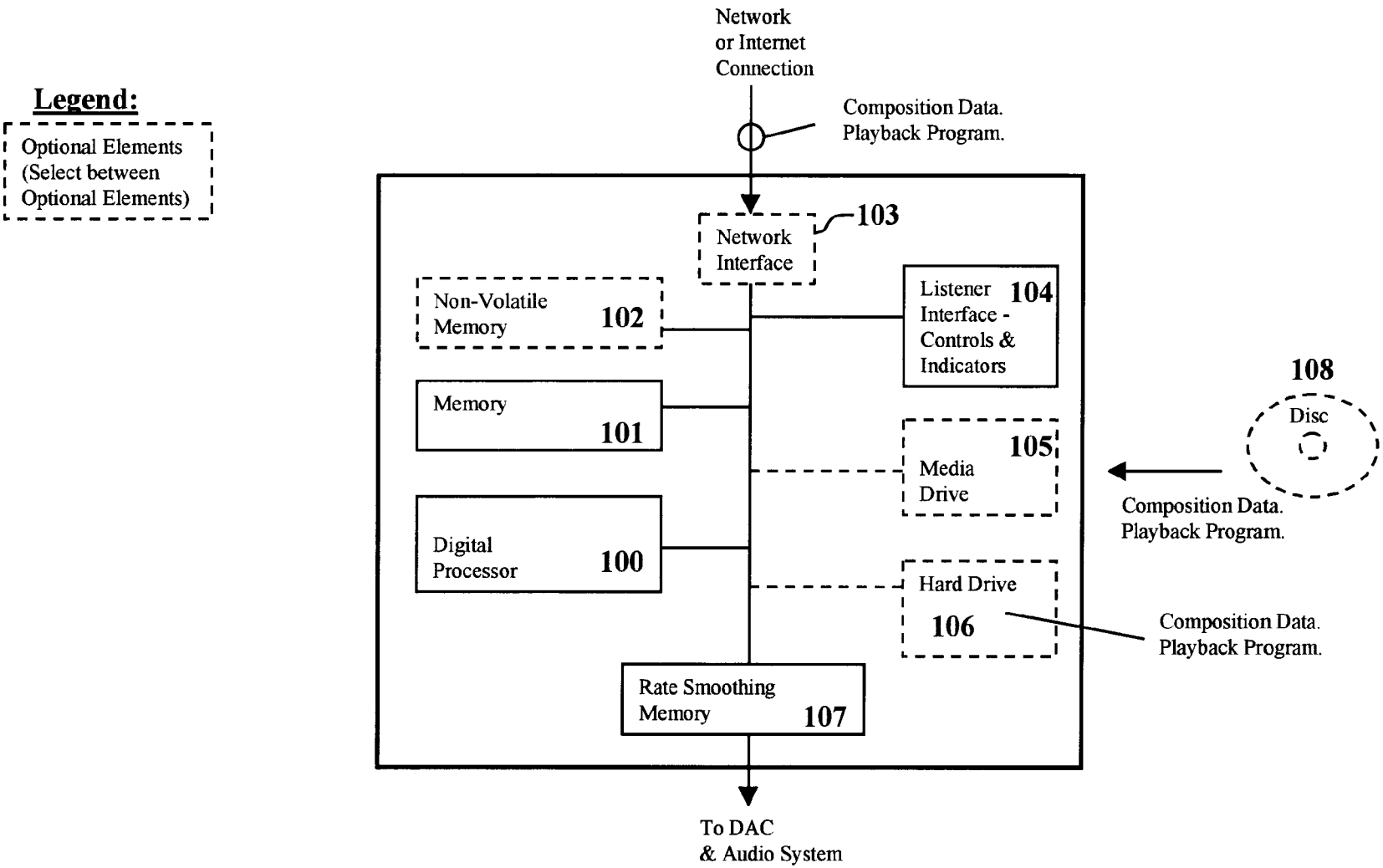
FIG. 10 is a hardware block diagram of a pseudo-live playback device.

FIG. 10 shows an embodiment of a pseudo-live playback device. Each time a recording artist's composition is played back by the device, a unique musical version is generated. The playback device can be made portable and mobile if desired.

The basic elements are the digital processor 100 and the memory 101. The digital processor 100 executes the playback program code to process the composition data to generate a unique sequence of sound samples. The memory 101 holds portions of the composition data, playback program code and working storage. The working storage includes the intermediate parameters, lists and tables (see FIG. 9) created by the playback program during the playback.

The digital processor 100 can be implemented with any digital processing hardware such as Digital processors, Central Processing Units (CPU), Digital Signal Processors (DSP), state machines, controllers, micro-controllers, Integrated Circuits (IC's) and Field Programmable Gate Arrays (FPGA's). The digital processor 100 places the completed sound samples in time order into the rate-smoothing memory 107, typically in non-uniform bursts, as samples are processed by the playback program.

The memory 101 can be implemented using random access memory, registers, register files, flip-flops, integrated circuit storage elements, and storage media such as disc, or even some combination of these.

The output side of the rate-smoothing memory 107, is able to feed samples to the DAC (digital to analog converter) & audio system at a uniform sampling rate. Sending data into the rate-smoothing memory does not interfere with the ability to provide samples at the desired times (or sampling rate) to the DAC. Possible implementations for the rate-smoothing memory 107 include a first-in first-out (FIFO) memory, a double buffer, or a rolling buffer located within the memory 101 or even some combination of these. There may be a single rate-smoothing memory dedicated to each audio output channel or the samples for the "n" channels can be time interleaved within a single rate-smoothing memory.

The music player includes listener interface controls and indicators 104. Besides the usual audio type controls, there may optionally be a dial or slider type control for playback variability. This control would allow the listener to adjust the playback variability % from 0% (no variability=artist defined fixed playback) to the 100% (=maximum level of variability defined by the artist). See FIG. 16 for additional details.

The playback device may optionally include a media drive 105 to allow both composition data and playback programs to be read from disc media 108 (or digital tape, etc). For the listener, operation of the playback device would be similar to that of a compact disc player except that each time a recording artist's composition is played back, a unique musical version is generated rather then the same version every time.

The playback device may optionally include a network interface 103 to allow access to the Internet, other networks or mobile type networks. This would allow composition data and the corresponding playback programs to be downloaded when requested by the user.

The playback device may optionally include a hard drive 106 or other mass storage device. This would allow composition data and the corresponding playback programs to be stored locally for later playback.

The playback device may optionally include a non-volatile memory to store boot-up data and other data locally.

The DAC (digital to analog converter) translates the digital representation of the composition's time samples into analog signals that are compatible with any conventional audio system such as audio amplifiers, equalizers and speakers. A separate DAC may be dedicated to each audio output channel.

Pseudo-Live Playback Applications

There are many possible pseudo-live playback applications, besides the Pseudo-Live Playback Device shown in FIG. 10.

Figure 12:
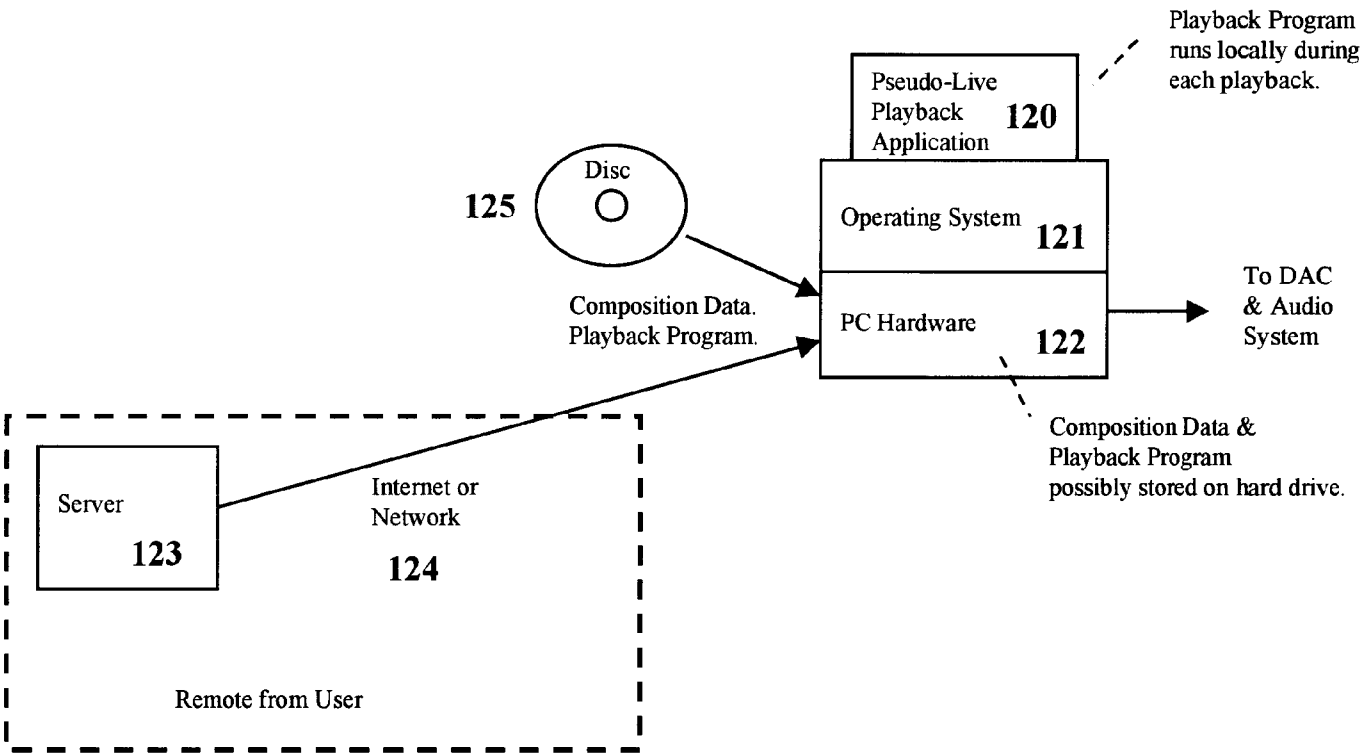
FIG. 12 shows an example of a personal computer (PC) based pseudo-live playback application (playback).

FIG. 12 shows an example of a personal computer (PC) application for playing back pseudo-live music. Here a pseudo-live playback application 120 (software program) sits above the PC operating system 121 and PC hardware 122. The composition data and playback program are provided to the PC via media (such as Disc 125 or Digital Tape) or remotely from a Server 123 over the Internet or network 124. The composition data and playback program may be optionally stored on the PC's hard drive or other media drive. The playback program is executed locally to generate a unique version of the artist's composition each playback.

Figure 13:
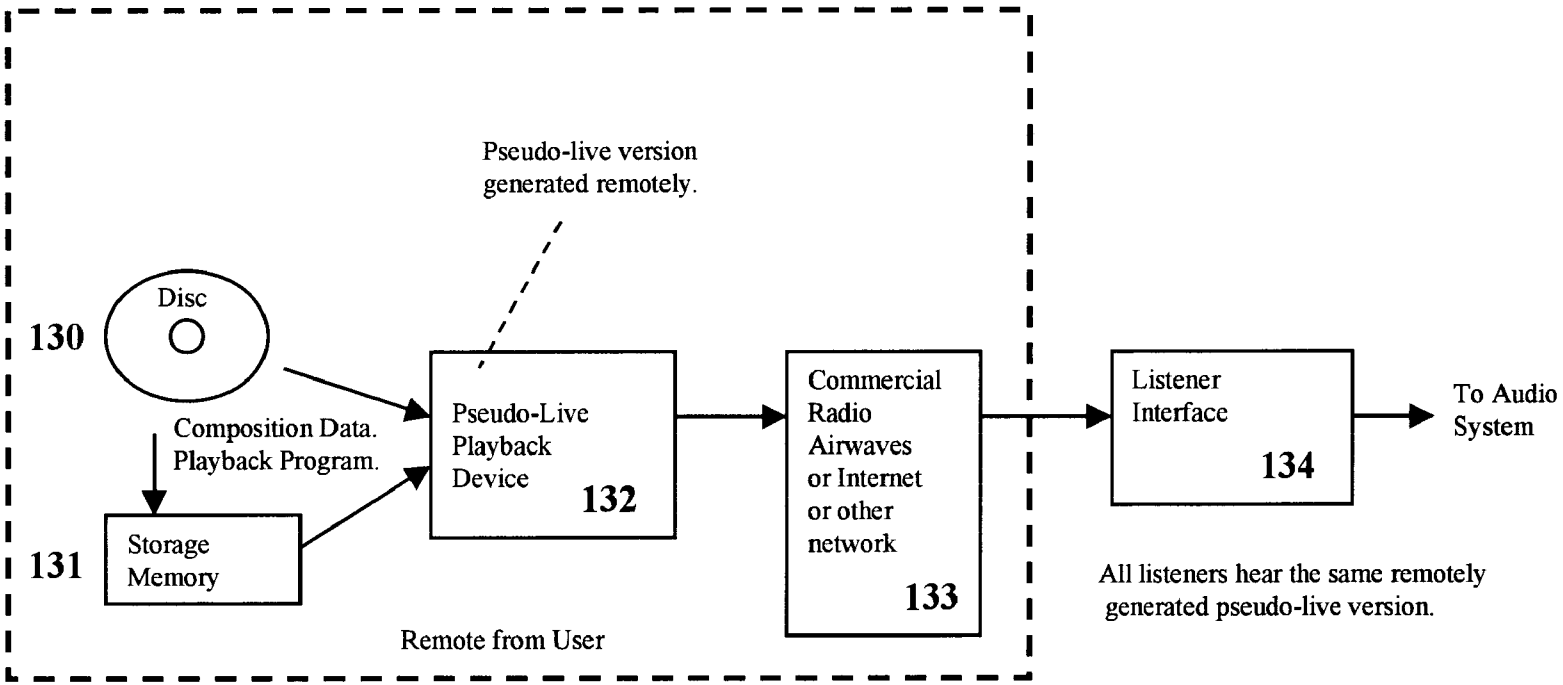
FIG. 13 shows an example of the broadcast of pseudo-live music over the commercial airwaves, Internet or other networks (playback).

FIG. 13 shows an example of the broadcast of pseudo-live music over commercial airwaves (e.g., AM or FM radio), the Internet or other networks 133. A pseudo-live playback device 132 accesses the composition data and playback program from media 130 or a storage memory 131. The playback device 132 generates a unique version of the artist's composition each playback, remotely from the listeners. The information sent to the listener may have the same format as today's static music. The pseudo-live playback version is captured by a listener's interface function 134 and then sent to the audio system. The pseudo-live music is generated remotely from the listeners. Note that on each playback, all listeners will hear the same but unique version of the artist's composition.

Figure 14:
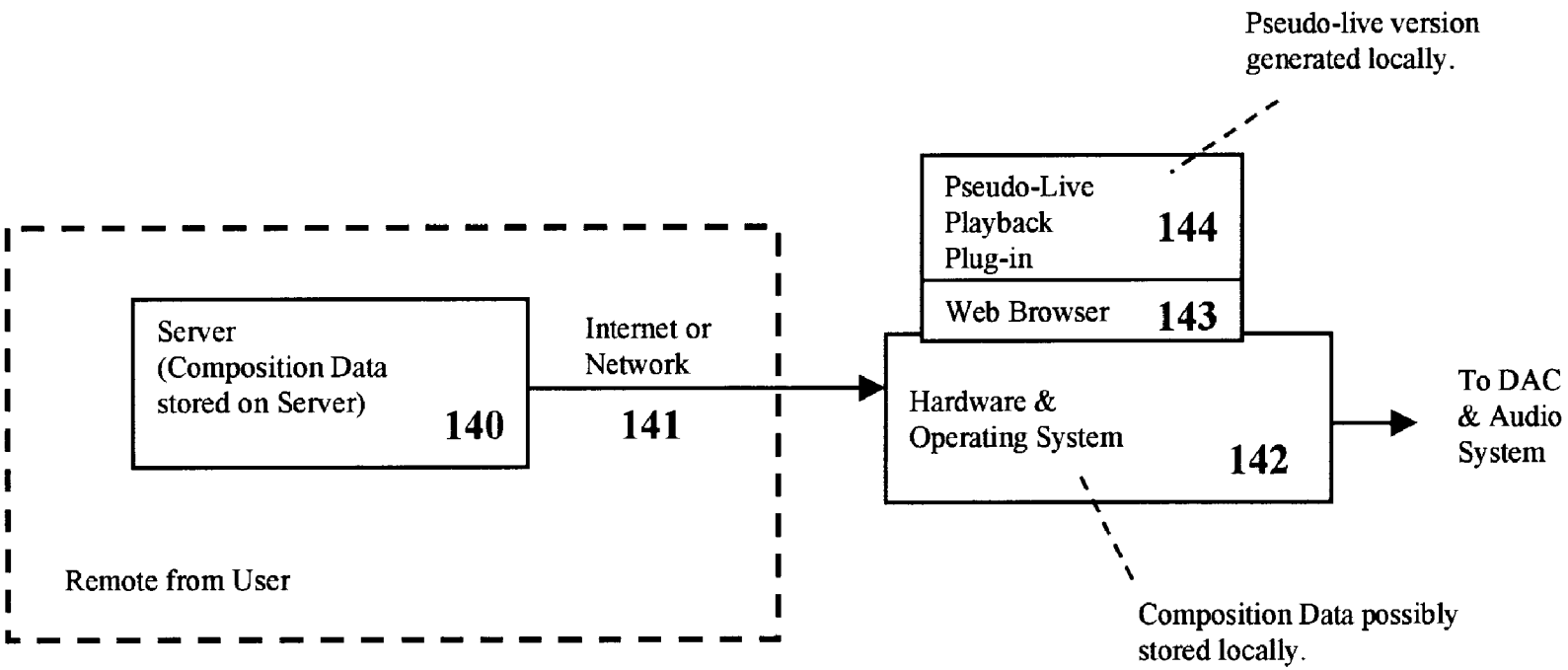
FIG. 14 shows a browser based pseudo-live music service (playback).

FIG. 14 shows an example of a web browser based pseudo-live music service. Composition data is available remotely on a server 140 and is sent to the user when requested over the Internet or other network 141. A pseudo-live playback plug-in 144, runs inside the web browser 143. The Web browser 143 runs on top of the hardware and operating system 142. Composition data may be stored locally for playback at a later time. A pseudo-live version is generated locally each time a composition is played back.

Figure 15:
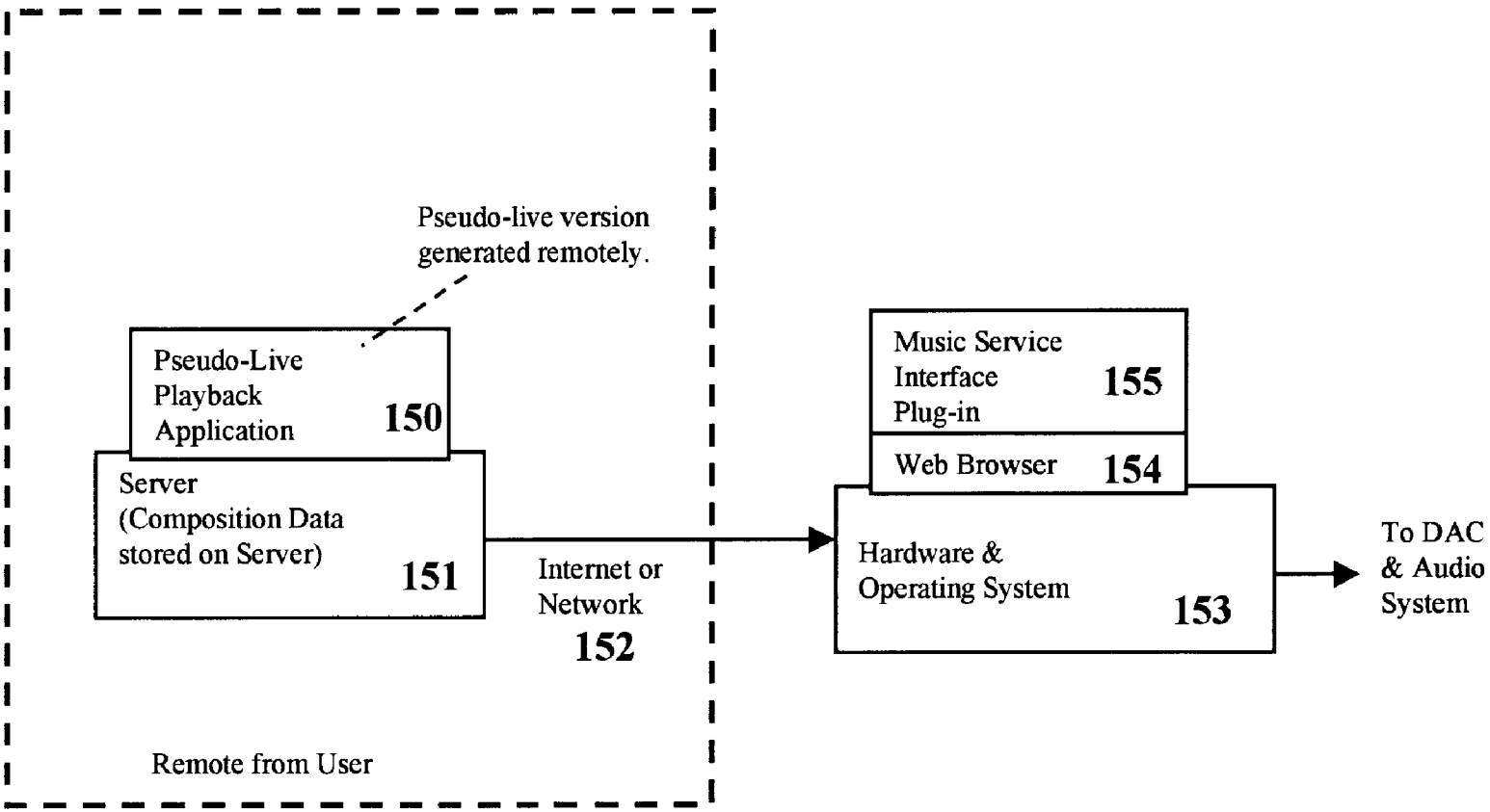
FIG. 15 shows a remote pseudo-live music service via a web browser (playback).

FIG. 15 shows an example of a remote music service via a Web browser. A pseudo-live playback application 150 is run on a remote server 151 to generate a unique pseudo-live version remotely from the user during playback. The unique playback version is sent to the listener over the Internet or another network 152. The user selects the desired composition via a music service plug-in 155 that plugs into a Web browser 154. The Web browser runs on top of the hardware and operating system 153. The pseudo-live playback program is executed remotely from the listener. The listener hears an individualized version of the artist's composition.

Pipelining to Shorten Delay to Music Start (Optional Playback Enhancement)

An optional enhancement to this invention's embodiment allows the music to start sooner by pipelining the playback process. Pipelining is not required but can optionally be used as an enhancement.

Pipelining is accomplished by partitioning the composition data of FIG. 5 into time intervals. The ordering of the partitioned composition data is shown in the first row of FIG. 11, which illustrates the order that data is downloaded over a network and initialized in the processor during playback. The data order is:

1.) Playback program 24
2.) Setup data 50
3.) Interval 1 groups & snippets 110
4.) Interval 2 groups & snippets 111
5.) . . . additional interval data . . .
6.) Last Interval groups & snippets 112

Figure 11:
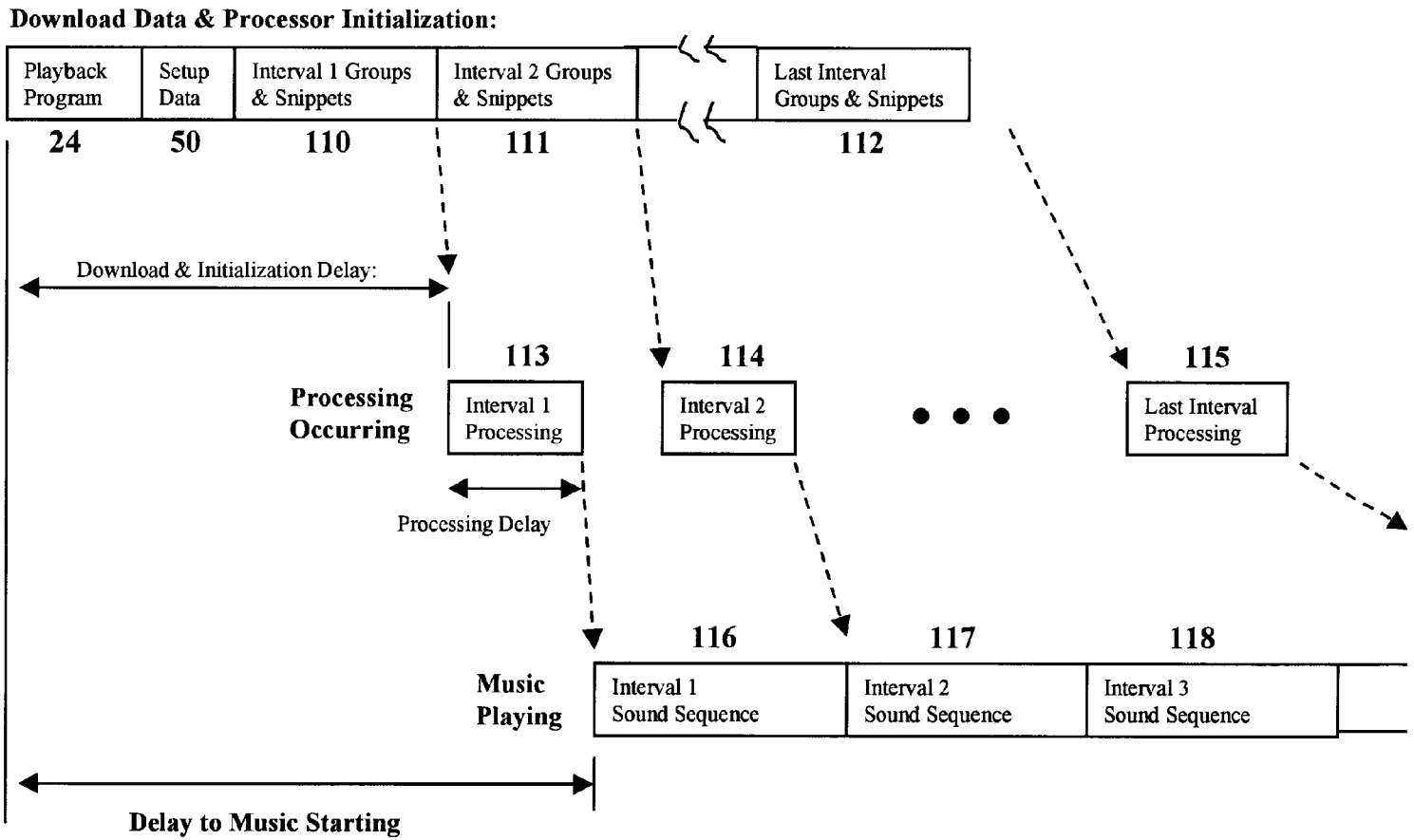
FIG. 11 shows how pipelining can be used to shorten the delay to music start (playback).

Playback processing can begin after interval 1 data is available. Playback processing occurs in bursts as shown in the second row of FIG. 11. As shown in FIG. 11, the start of processing is delayed by the download and initialization delay. Processing for each interval (113, 114, . . . 115) begins after the data for each interval becomes available.

After the interval 1 processing delay (i.e., the time it takes to process interval 1 data), the music can begin playing. As each interval is processed, the sound sequence data is placed into an output rate-smoothing memory. This memory allows the interval sound sequence data (116, 117, 118, . . . ) to be provided at a uniform sample rate to the audio system. Note that processing is completed on all desired channels before beginning processing on the next interval. As shown in FIG. 11, the total delay to music starting is equal to the download & initialization delay plus the processing delay.

Constraints on the pipelining described above are:

1.) All groups and snippets that may be needed for an interval must be provided before the processing of an interval can begin.
2.) The download & initialization time of all intervals following interval 1, should be less than the sound sequence time duration of the shortest interval.
3.) The processing delay for all intervals should be less than the sound sequence time duration of the shortest interval.

Note that, any chain of snippets can be re-divided into another chain of partitioned shorter length snippets to yield an identical sound sequence. Hence, pipelining may shorten the length of snippets while it increases both the number of snippets and the number of spawned groups used. But note that, the use of pipelining, does not constrain what the artist can accomplish.

Variability Control (Optional Playback Enhancement)

An optional enhancement, not required by the basic embodiment, is a variability control knob or slider on the playback device. The variability can be adjusted by the user from between "none" (0% variability) and "max" (100% variability). At the "none" (0%) setting, all variability would be disabled and playback program will generate only the single default version defined by the artist (i.e., there is no variability from playback to playback). The default version is generated by always selecting the first snippet in every group and disabling all edit and placement variability. At the "max" (100%) setting, all the variability in the artist's composition is used by the playback program. At the "max" (100%) setting, snippets are selected from all of the snippets in each group while the full amount of the artist defined edit variability and placement variability are applied. At settings between "none" and "max", a fraction of the artist's defined variability is used, for example only some of the snippets in a group are used while snippet edit variability and placement variability would be proportionately scaled down. For example if the "Variability %" set to 60%, then the snippet selection is limited to the first 60% of the snippets in the group, chosen according to the "snippet selection method". Similarly, only 60% of the artist defined edit variability and placement variability is applied.

Another optional enhancement, not required by the basic embodiment, is an artist's specification of the variability as a function of the number of calendar days since the release of the composition (or the number of times the composition has been played). For example, the artist may define no variability for two months after the release of a composition and then gradually increasing or full variability after that. The same technique, described in the preceding paragraph, to adjust the variability between 0% and 100% could be utilized.

Figure 16:
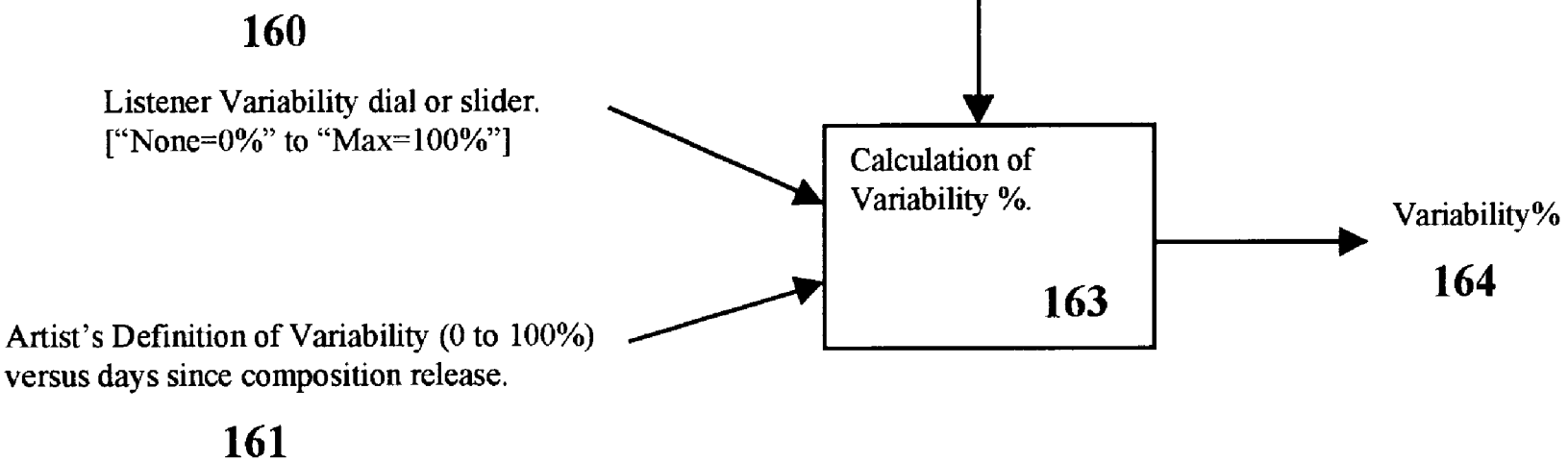
FIG. 16 shows a flow diagram for determining variability % (playback).

FIG. 16 shows a flow diagram for the generation of the Variability %. One input to this process is an encoded signal representing "none" (0%) to "max" (100%) variability from a listener variability dial or slider 160. Options for the implementation of the knob or slider include a physical control or a mouse/keyboard controlled representation on a graphical user interface. Another input to the process is the artist's definition of variability versus days since composition release 161. This definition would be included in the setup data fields of the composition data (see FIG. 5). A third input to this process is Today's date 162. Using these inputs, the "Calculation of Variability %" 163 generates the "Variability %" 164.

Other Optional Playback Enhancements

Other optional enhancements, not required by the basic embodiment are:

1.) Execution of the playback program code within a security protected virtual machine in order to protect the playback device and it's files from corruption caused by the execution of a malicious software program.

2.) Performing inter-channel special effects editing during playback processing. This can be accomplished by the addition of a few parameters into the snippet parameters 56. An inter-channel edit flag would be added to each of the spawned groups 58*a* through 58*p*. When the flag is set, it signals that the selected snippet from the group, is to be inter-channel edited with the other spawned groups (58*a*–58*p*) that have the flag set. The inter-channel edit parameters needed by the inter-channel processing subroutine would be added to the edit variability parameters located in block 57.

3.) Encryption methods may be used to protect against the unauthorized use of the artist's snippets.

Disadvantages and How to Overcome

The left column of the table in FIG. 17, lists the disadvantages of pseudo-live music compared with the conventional "static" music of today's recording industry. The right column in the table indicates how each of these disadvantages can be overcome with the continuous rapid advancement and decreasing cost of digital technologies. The currently higher cost of pseudo-live music, compared with "static" music, will become increasingly smaller and eventually insignificant in the near future.

Although the above discussion is directed to the creation and playback of music and audio by recording artists, it may also be applied to any other type of audio creation.

I claim:

1. A method for playing back a variable music or audio composition, comprising:

providing a variable composition having a plurality of groupings of sound segments, each said grouping comprising one or more sound segments, wherein some sound segments may be included in more than one grouping;

providing for some segments in said composition, one or more spawn-definitions for each segment, wherein each spawn-definition identifies one of said groupings and a grouping insertion time;

starting playback of said composition with a pre-defined starting grouping;

variably selecting at least one segment from the pre-defined starting grouping;

during playback, processing the spawn-definitions for each segment selected from the pre-defined starting grouping to initiate one or more additional groupings;

selecting at least one segment from each initiated additional grouping;

placing each selected segment at the insertion time defined for the grouping it was selected from; and combining all placed segments to form a sound sequence in one or more output channels, whereby each time a composition is played back, a different sound sequence is automatically generated, without requiring listener action.

2. A method as claimed in claim 1 further comprising, processing the spawn-definitions for all subsequently selected segments to initiate additional groupings and selecting at least one segment Thorn each subsequently initiated grouping.

3. A method as claimed in claim 1 wherein each said spawn-definition further includes a channel identifier, so said placing and combining occurs in a plurality of channels, whereby each time a composition is played a different sound sequence is automatically generated in said plurality of sound channels.

4. A method as claimed in claim 1 wherein some of the segments are created by the artist, simultaneously with the artist creating or listening to other segments.

5. A method as claimed in claim 1 wherein some of the segments are created by the artist by mixing together tracks, and wherein some of said tracks are created by the artist simultaneously with creating or listening to other tracks or segments.

6. A method as claimed in claim 1 wherein each variable composition is defined in a composition data set compatible with a playback program, and wherein said playback program is compatible with a plurality of different variable composition data sets.

7. A method as claimed in claim 6 further including incorporating said playback program in a playback device to playback a plurality of variable compositions.

8. A method as claimed in claim 1 wherein the insertion time for each grouping, is at a specified time within said initiating segment.

9. A method as claimed in claim 1 wherein the insertion time for each grouping, is at a specified time within said composition.

10. A method as claimed in claim 1 wherein combining includes mixing together said selected segments that overlap in time in the same sound channel.

11. A method as claimed in claim 1 wherein said selection of a segment from a grouping is random.

12. A method as claimed in claim 1 wherein at least one of said groupings is comprised of a plurality of segments that are created during playback, when needed, from a single segment using real-time special effects processing defined in the composition.

13. A method as claimed in claim 1 further comprising incorporating optional variable effects editing on each said selected segment before it is placed, wherein said effects editing includes applying a variable amount of echo, reverb, or amplitude effects.

14. A method as claimed in claim 1 further comprising inter-channel variable effects editing of said selected segments before they are placed.

15. A method as claimed in claim 1 wherein placing includes optionally calculating and utilizing a variation, that differs from playback to playback, around said insertion time defined in each spawn-definition.

16. A method as claimed in claim 1 further comprising adapting the composition playback to characteristics of a playback device.

17. A method as claimed in claim 1 wherein the method is performed in a pipeline manner.

18. A method as claimed in claim 1 wherein said selecting of segments is restricted to a fraction of the segments in each grouping based on a listener's variability control that is incorporated into a playback device, whereby the relative amount of variability is listener adjustable.

19. A method as claimed in claim 1 wherein said selecting of segments is restricted to a fraction of the segments in each grouping based on a definition of variability as a function of days since composition release or number of times played.

20. A method as claimed in claim 1 further comprising, using a rate smoothing memory to provide a uniform sound sample rate at the output, even though the processing rate of each sample may vary from sample to sample.

21. A variable music or audio composition, comprising:

a plurality of groupings of sound segments, each said grouping comprising one or more sound segments wherein some sound segments may be included in more than one grouping;

one or more spawn-definitions for each segment for some of said segments, wherein each spawn-definition identifies one of said groupings and a grouping insertion time a pre-defined starting grouping;

means for variably selecting at least one segment from the pre-defined starting grouping;

means for processing the spawn-definitions for each segment selected from the starting grouping to initiate one or more additional groupings;

means for selecting at least one segment from each initiated additional grouping;

means for placing each selected segment at the insertion time defined for the grouping it was selected from; and means for combining all placed segments to form a sound sequence in one or more output channels, whereby each time a composition is played back, a different sound sequence is automatically generated, without requiring listener action.

22. A composition as claimed in claim 21 further comprising means for processing the of spawn-definitions for all subsequently selected segments to initiate additional groupings and for selecting at least one segment from each subsequently initiated grouping.

23. A composition as claimed in claim 21 further including a plurality of channels, wherein said means for placing and combining is located in a plurality of channels, whereby each time a composition is played a different sound sequence is automatically generated in a plurality of sound channels.

24. A composition as claimed in claim 21 wherein some of said segments are artist created segments, created simultaneously while creating or listening to other segments.

25. A composition as claimed in claim 21 wherein some of the segments are an artist mix of a plurality of tracks, wherein some of said tracks were created by the artist simultaneously with creating or listening to other tacks or segments.

26. A composition as claimed in claim 21 wherein each variable composition is defined in a composition data set compatible with a playback program, wherein said playback program is compatible with a plurality of different variable composition data sets.

27. A composition as claimed in claim 26 wherein a playback device incorporates said playback program to playback a plurality of variable compositions.

28. A composition as claimed in claim 21 wherein said insertion time for each grouping, is at a specified time within said initiating segment.

29. A composition as claimed in claim 21 wherein said insertion time for each grouping, is at a specified time within said composition.

30. A composition as claimed in claim 21 wherein said means for combining includes means for mixing together said selected segments that overlap in time in the same sound channel.

31. A composition as claimed in claim 21 further comprising means for randomly selecting a segment from a grouping.

32. A composition as claimed in claim 21 wherein at least one of said groupings is comprised of a plurality of segments that are created, when needed, from a single segment using real-time special effects processing, as defined in the composition.

33. A composition as claimed in claim 21 further comprising means for optional variable effects editing on each said selected segment before it is placed, wherein said effects editing includes means for applying a variable amount of echo, reverb, or amplitude effects.

34. A composition as claimed in claim 21 further comprising means for inter-channel variable effects editing of said selected segments before they are used.

35. A composition as claimed in claim 21 further comprising means for optionally calculating and utilizing a variation, that differs from playback to playback, round said insertion time defined in each spawn-definition.

36. A composition as claimed in claim 21 further comprising means for adapting the composition playback to characteristics of a playback device.

37. A composition as claimed in claim 21 further comprising means for performing the playback in a pipeline manner.

38. A composition as claimed in claim 21 further comprising means for adjusting the relative amount of composition playback variability based on a listener's variability control that is incorporated into a playback device.

39. A composition as claimed in claim 21 further comprising means for adjusting the relative amount of composition playback variability based on a definition of variability as a function of days since composition release or number of times played.

40. A composition as claimed in claim 21 further comprising, a rate smoothing memory to provide a uniform sound sample rate at the output, even though the processing rate of each sample may vary from sample to sample.

41. A playback device for a variable music or audio composition, comprising:

a. storage means for holding said composition comprising,
   - a plurality of groupings of sound segments, each said grouping comprising one or more sound segments, wherein some sound segments may be included in more than one grouping;
   - one or more spawn-definitions for each segment for some of said segments, wherein each spawn-definition identifies one of said groupings and a grouping insertion time;

b. processing means including
   - means for starring the playback of the composition with a pre-defined starting grouping;
   - means for variably selecting at least one segment from said starring grouping;
   - means for processing the spawn-definitions for each segment selected from the starring grouping in-order to initiate one or more additional groupings;
   - means for selecting at least one segment from each said initiated grouping;
   - means for placing each selected segment at the insertion time defined for the grouping it was selected from; and
   - means for combining all placed segments into a sound sequence in one or more output channels, whereby each time a composition is played back, a different sound sequence is automatically generated, without requiring listener action.

42. A playback device as claimed in claim 41 further comprising means for processing the spawn-definitions for all subsequently selected segments to initiate additional groupings and for selecting at least one segment from each subsequently initiated grouping.

43. A playback device as claimed in claim 41 further including a plurality of channels, wherein each of said means for placing and combining is located in a plurality channels, whereby each time a composition is played a different sound sequence is automatically generated in a plurality of sound channels.

44. A playback device as claimed in claim 41 wherein some of said segments are artist created segments, created by the artist simultaneously while creating or listening to other segments.

45. A playback device as claimed in claim 41 wherein some of the segments are an artist mix of a plurality of tracks, wherein some of said tracks were created by the artist simultaneously with creating or listening to other tracks or segments.

46. A playback device as claimed in claim 41 wherein each variable composition is defined in a composition data set compatible with a playback program, wherein said playback program is compatible with a plurality of different variable composition data sets.

47. A playback device as claimed in claim 46 wherein said playback device incorporates said playback program to playback a plurality of variable compositions.

48. A playback device as claimed in claim 41 wherein said insertion time for each grouping, is at a specified time within said initiating segment.

49. A playback device as claimed in claim 41 wherein said insertion time for each grouping, is at a specified time within said composition.

50. A playback device as claimed in claim 41 wherein said means for combining includes means for mixing together said selected segments that overlap in time in the same sound channel.

51. A playback device as claimed in claim 41 further comprising means for randomly selecting a segment from a grouping.

52. A playback device as claimed in claim 41 wherein at least one of said groupings is comprised of a plurality of segments that are created, when needed, from a single segment using real-time special effects processing, as defined in the composition.

53. A playback device as claimed in claim 41 further comprising means for optional variable effects editing on each said selected segment before it is placed, wherein said means for effects editing includes means for applying a variable amount of echo, reverb, or amplitude effects.

54. A playback device as claimed in claim 41 further comprising means for inter-channel variable effects editing of said selected segments before they are used.

55. A playback device as claimed in claim 41 wherein said means for placing includes means for optionally calculating and utilizing a variation, that differs from playback to playback, around said insertion time defined in each spawn-definition.

56. A playback device as claimed in claim 41 further comprising means for adapting the composition playback to characteristics of a playback device.

57. A playback device as claimed in claim 41 further comprising means for performing the playback in a pipeline manner.

58. A playback device as claimed in claim 41 further comprising means for adjusting the relative amount of composition playback variability based on a listener's variability control that is incorporated into a playback device.

59. A playback device as claimed in claim 41 further comprising means for adjusting the relative amount of composition playback variability based on a definition of variability as a function of days since composition release or number of times played.

60. A playback device as claimed in claim 41 further comprising, a rate smoothing memory to provide a uniform sound sample rate at the output, even though the processing rate of each sample may vary from sample to sample.

* * * * *

UNITED STATES PATENT AND TRADEMARK OFFICE

CERTIFICATE OF CORRECTION

PATENT NO. : 6,683,241 B2
DATED : April 6, 2004
INVENTOR(S) : James W. Wieder

It is certified that error appears in the above-identified patent and that said Letters Patent is hereby corrected as shown below:

Column 7,
Line 11, change “sang” to -- song --.

Column 20,
Line 44, change “Thorn” to -- from --.

Column 22,
Line 20, change “tacks” to -- tracks --.
Line 58, change “round” to -- around --

Column 23,
Lines 25, 28 and 30, change “starring” to -- starting --,

Signed and Sealed this

Sixth Day of July, 2004

JON W. DUDAS
*Acting Director of the United States Patent and Trademark Office*